US012378031B2

(12) United States Patent
Yohe et al.

(10) Patent No.: US 12,378,031 B2
(45) Date of Patent: Aug. 5, 2025

(54) APPARATUS AND METHOD FOR DEBAGGING ARTICLE ARRAYS

(71) Applicant: DYCO, INC., Bloomsburg, PA (US)

(72) Inventors: Peter D. Yohe, Bloomsburg, PA (US); Ronald H. Cordingly, Berwick, PA (US)

(73) Assignee: DYCO, Inc., Bloomsburg, PA (US)

( * ) Notice: Subject to any disclaimer, the term of this patent is extended or adjusted under 35 U.S.C. 154(b) by 80 days.

(21) Appl. No.: 18/191,605

(22) Filed: Mar. 28, 2023

(65) Prior Publication Data

US 2024/0327051 A1 Oct. 3, 2024

(51) Int. Cl.
*B65B 69/00* (2006.01)
*B65B 35/30* (2006.01)

(52) U.S. Cl.
CPC ..... *B65B 69/0025* (2013.01); *B65B 35/30* (2013.01); *B65B 69/0008* (2013.01)

(58) Field of Classification Search
CPC .. B65B 69/0025; B65B 35/30; B65B 69/0008
See application file for complete search history.

(56) References Cited

U.S. PATENT DOCUMENTS 3,266,541 A * 8/1966 Kluytenaar ..... B65B 69/0033 83/72
3,889,442 A * 6/1975 Grahn ..... B65B 43/38 414/412
3,926,322 A * 12/1975 Scott ..... B65B 69/0033 414/412
4,390,313 A * 6/1983 Hoehn ..... B65B 69/0033 414/412
4,592,698 A * 6/1986 Semp ..... A24B 3/00 414/412
4,696,615 A * 9/1987 Ettischer ..... B65H 1/30 399/361
5,069,594 A * 12/1991 Bott ..... B65B 69/0033 53/381.1
5,318,399 A * 6/1994 Marom ..... B65B 69/0025 414/412
5,368,431 A * 11/1994 Willey ..... B65B 69/0008 414/412
5,371,938 A * 12/1994 Martin ..... B65B 69/0033 414/412

(Continued)

*Primary Examiner* — Gloria R Weeks
*Assistant Examiner* — Katie L Gerth
(74) *Attorney, Agent, or Firm* — McNees Wallace & Nurick LLC

(57) ABSTRACT

A system for removing a packing material of an article array including a staging area for receiving the article array packaged with the packing material, a transport device configured to transport the article array in a length direction extending from a first end to a second end of the system, a first cutter configured to cut the packing material in a direction perpendicular with respect to the length direction of the system, a debagging area configured to sequentially receive from the transport device the article array and to remove the packing material from the article array, the debagging area includes a first gripper and a second gripper configured to engage and remove the packing material, and a packing material collection area configured to receive the packing material from the first and second grippers and collect the packing material to be discarded.

20 Claims, 35 Drawing Sheets

(56) References Cited

U.S. PATENT DOCUMENTS

| | | | | |
|---|---|---|---|---|
| 5,725,349 | A * | 3/1998 | Garvey | B65B 69/0033 414/412 |
| 7,341,416 | B1 * | 3/2008 | Rubtsov | B65B 69/0025 414/412 |
| 7,549,274 | B2 * | 6/2009 | Fraser | B65B 69/0033 414/412 |
| 7,963,086 | B2 * | 6/2011 | Porter | B65B 69/0025 53/381.1 |
| 8,490,252 | B2 * | 7/2013 | Stover | D01B 1/04 209/552 |
| 9,162,788 | B2 * | 10/2015 | Stone | B65B 69/0025 |
| 11,827,405 | B2 * | 11/2023 | Griffith | B65B 69/0033 |
| 11,897,652 | B2 * | 2/2024 | Pollard, Jr. | B26D 9/00 |
| 2003/0009994 | A1 * | 1/2003 | Hartness | B65B 21/183 53/251 |
| 2004/0055438 | A1 * | 3/2004 | Ours | B65B 69/0033 414/412 |
| 2004/0250670 | A1 * | 12/2004 | Porter | B65B 69/0025 83/401 |
| 2014/0097064 | A1 * | 4/2014 | Yohe | B65G 47/53 198/458 |
| 2015/0314903 | A1 * | 11/2015 | Aya | B65B 69/0008 414/412 |
| 2016/0318189 | A1 * | 11/2016 | Yohe | B25J 15/024 |
| 2016/0325944 | A1 * | 11/2016 | Yohe | B65G 57/03 |

* cited by examiner

APPARATUS AND METHOD FOR DEBAGGING ARTICLE ARRAYS

TECHNICAL FIELD

The present disclosure relates to an apparatus and method for debagging article arrays packaged in plastic material.

BACKGROUND

In many instances, it may be desirable to transport large quantities of articles, such as empty bottles, to a location for filling. To reduce the amount of handling required and/or to reduce the amount of shipping material consumed, the articles may be arranged in a tight grouping, or array, of articles. Each empty article arrays are typically separated from each other by wrapping a plastic bag to form a loaded pallet and ready for shipment. The article arrays can also form a layer of articles that can be arranged on a pallet having a footprint which can be accommodated by freight hauling compartments, e.g., for truck, rail, sea or air vessels.

However, prior to filling, the articles must be depalletized or unpackaged. Conventional depalletizing process, i.e., debagging, typically requires personnel to remove the packaging, i.e., flexible plastic bag, surrounding the articles, which is inefficient and expensive, as well as potentially hazardous for the personnel, as access to the articles may require the personnel to handle dangerous tools and/or equipment, such as, wrap cutters, knives, blades, scissors, and the like. In addition, there may be damage or breakage to the article itself during the debagging process, leading to costly replacement costs of damaged article(s).

Other approach utilizes a slitter knife between guide rails on one side and strip rails on the opposite side of the article array. The article array is first slit with the knife, then the plastic bag is manually pulled off by hand through the strip rail. However, this method is slow and labor-intensive, as either one or two operators are required for stripping the plastic bags.

There is a need for improved apparatus and methods for debagging article arrays that do not suffer from these shortcomings.

SUMMARY

In an exemplary embodiment, a system for removing a packing material of an article array including a staging area for receiving the article array packaged with the packing material, a transport device configured to transport the article array in a length direction extending from a first end to a second end of the system, a first cutter configured to cut the packing material in a direction perpendicular with respect to the length direction of the system, a debagging area configured to sequentially receive from the transport device the article array and to remove the packing material from the article array, the debagging area includes a first gripper and a second gripper configured to engage and remove the packing material, and a packing material collection area configured to receive the packing material from the first and second grippers and collect the packing material to be discarded.

In a further exemplary embodiment, a method of removing a packing material of an article array including receiving, in a staging area of a debagging system, the article array packaged with the packing material, transporting the article array in a first direction, cutting, in the staging area, the packing material in a direction which is perpendicular to the first direction, sequentially transporting the article array to a debagging area of the debagging system, cutting, in the debagging area, the packing material along in the first direction, wherein the cut made in the debagging area is perpendicular to the cut made in the staging area, removing the packing material from the article array by engaging the packing material via a gripper, and collecting, in a packing material collection area, the packing material to be discarded.

Other features and advantages of the present invention will be apparent from the following more detailed description of the preferred embodiment, taken in conjunction with the accompanying drawings which illustrate, by way of example, the principles of the invention.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of layers, regions and/or structural elements may be reduced or exaggerated for clarity. The use of similar or identical reference numbers in the various drawings is intended to indicate the presence of a similar or identical element or feature.

DETAILED DESCRIPTION OF EXAMPLE EMBODIMENTS

The present disclosure describes systems and methods for automatically debagging (i.e., removing, detaching, or stripping) article arrays packaged (i.e., surrounded or wrapped) in a packing material, such as, for example, a flexible plastic material. This creates an efficient and time-saving process in removal of the packing material. There is also no need for an operator to handle the article arrays for removing the packing material, unlike conventionally, tools and/or instruments were required or used, resulting in possible injuries to the operator and/or damage to the article itself.

Figure 1:
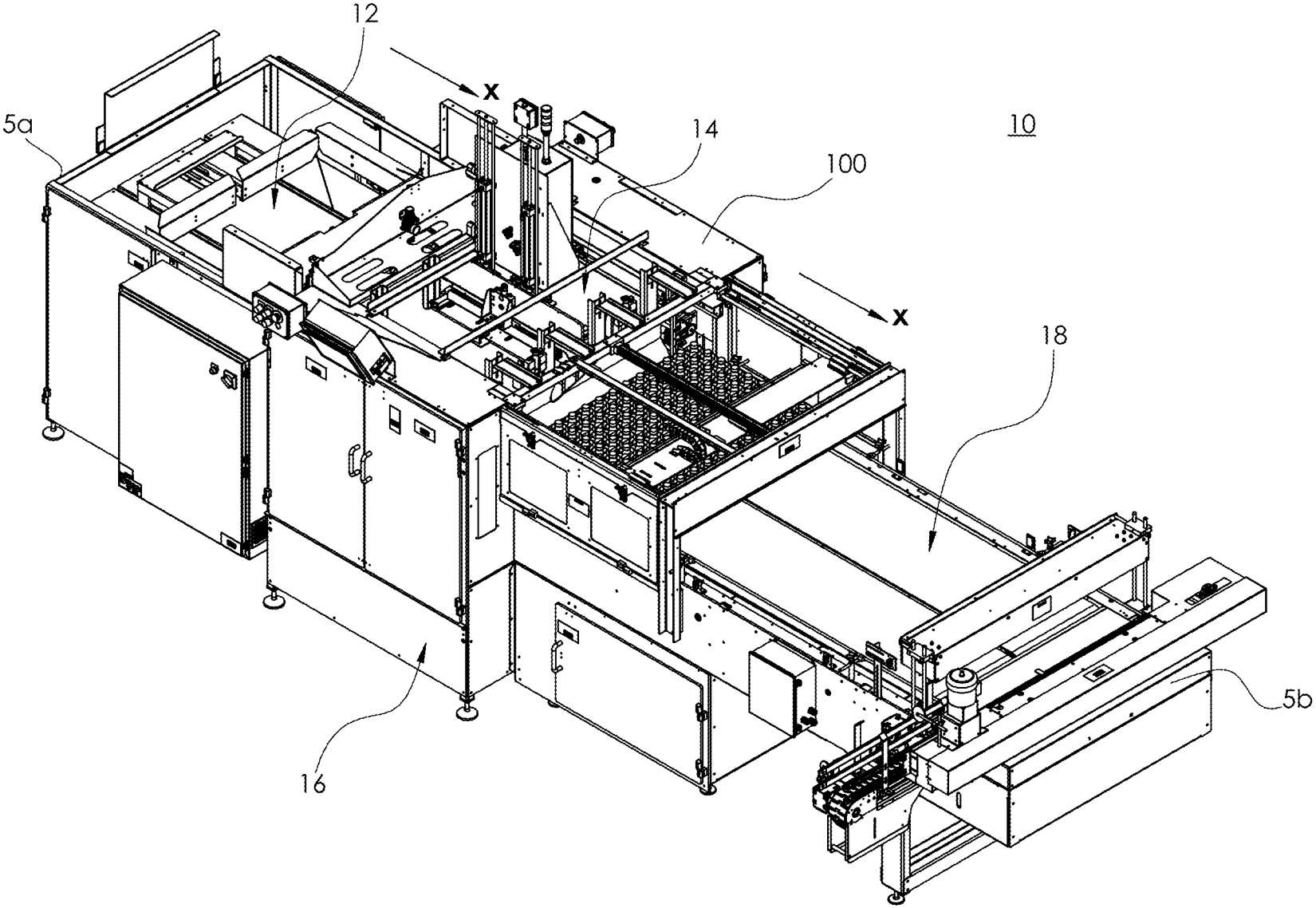
FIG. 1 is an upper perspective view of an exemplary debagging system, according to an example embodiment.
Figure 2:
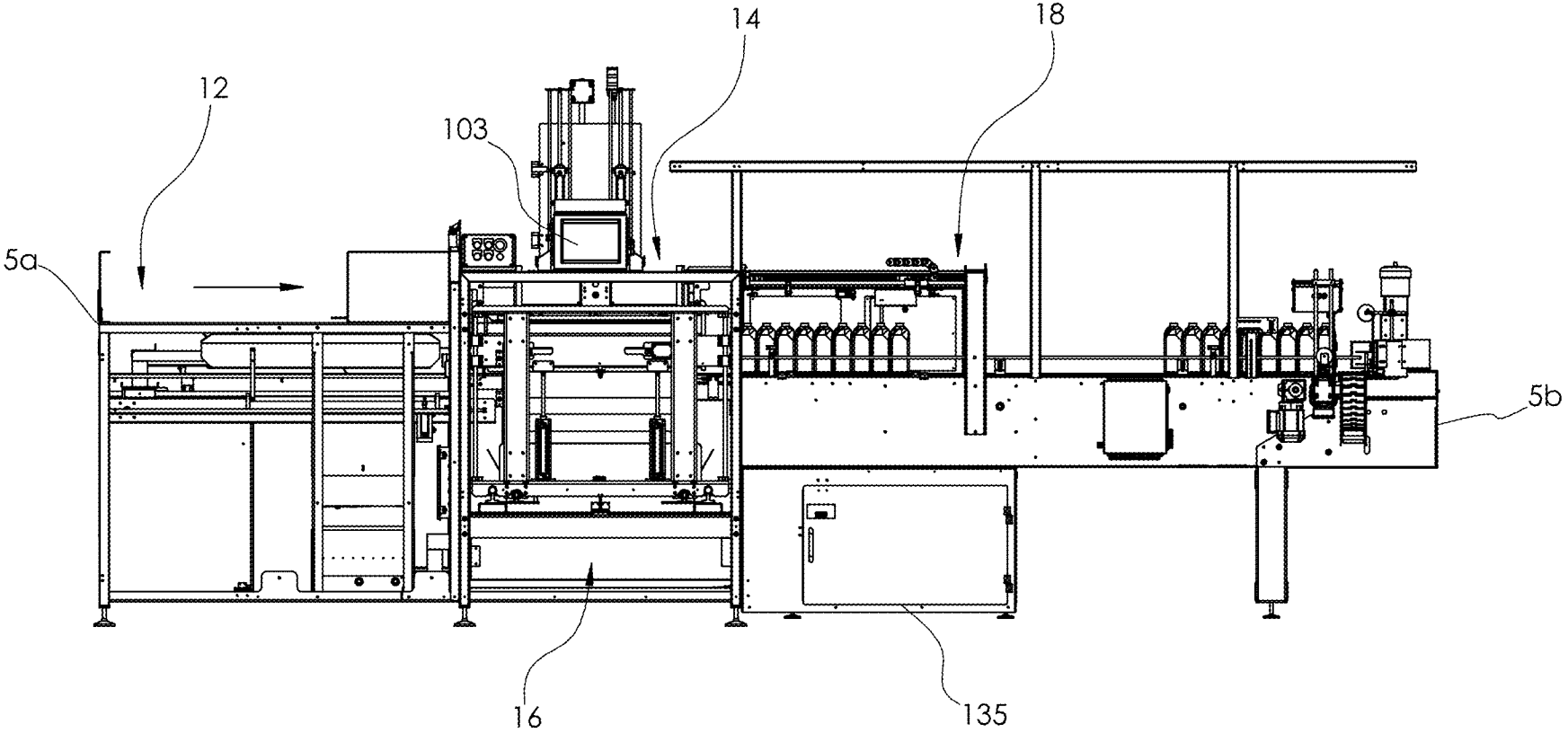
FIG. 2 is a side view of an exemplary debagging system of FIG. 1, according to an example embodiment.
Figure 18:
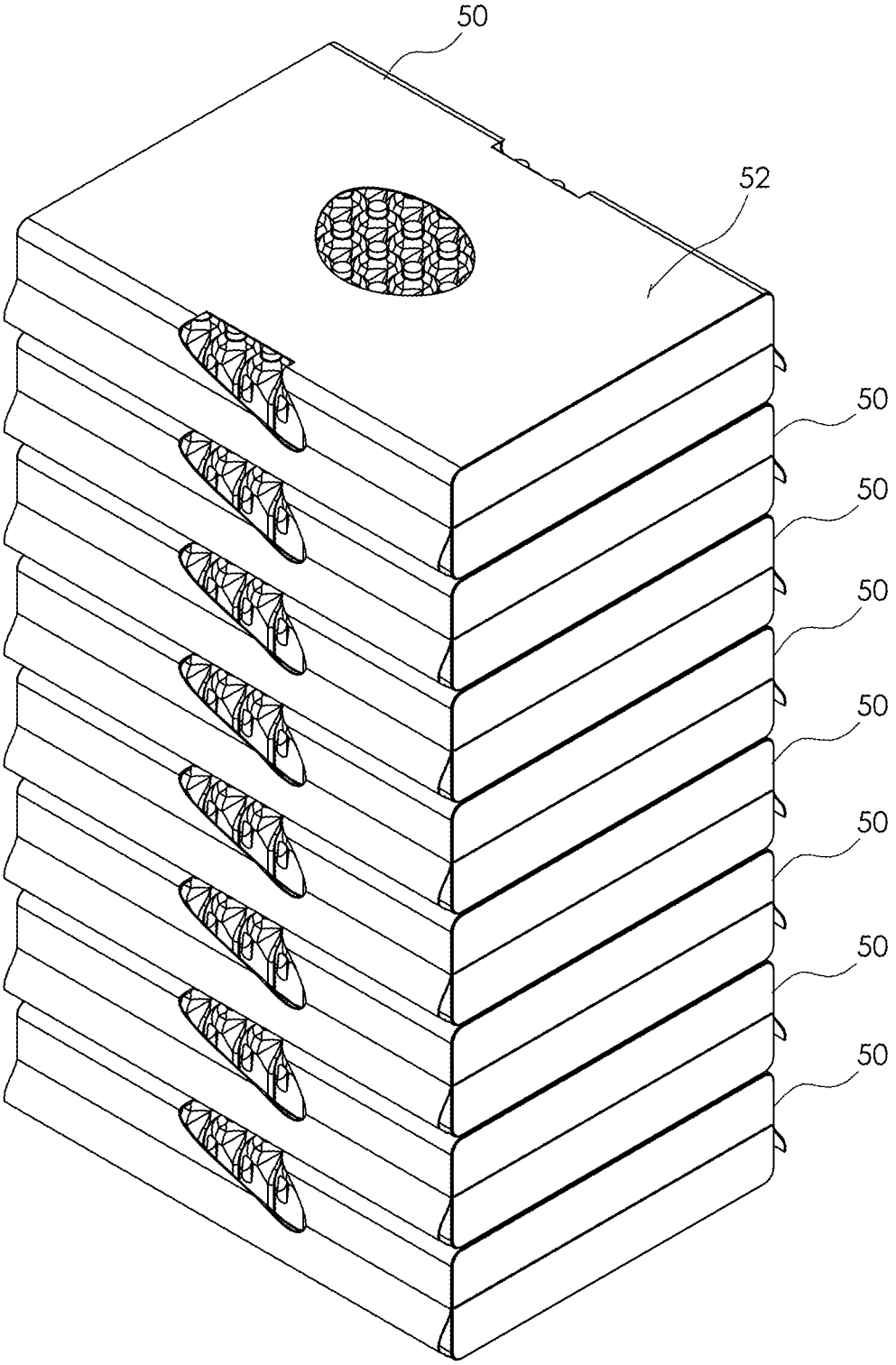
FIG. 18 is a perspective view of a stack of article arrays, according to an example embodiment.

Referring to FIG. 1, an automated system 10 and method for debagging an article array 50 packaged in a layer of packing material 52 (see FIG. 18) is shown. In some implementations, the packing material 52 can be for example, but not limited, to plastic, foil, shrink film, stretch film, bio-plastics, cardboard, paperboard, boxes, etc. In a preferred embodiment, the packing material 52 is a flexible plastic wrap made from polyvinyl chloride (PVC), polyethylene (P), polyolefin (POF) or the like. The system 10 includes a staging area 12 for receiving the article array 50 packaged in the layer of packing material 52, a debagging area 14 for removing the packing material 52 from the article array 50, a packing material collection area 16 below the debagging area 14 for collecting and storing the packing material 52 to be discarded, and an article collection area 18 after the packing material 52 has been removed for collecting the articles, e.g., bottles, to be transported to a filling system or process via a conveyor.

For purposes herein, the term "article array" may refer to two or more article rows packaged in a packing material until the packing material is removed or discarded. The term "length direction" may be used to describe the direction of travel of the article array 50 in the system 10. For example, the direction of travel of the article array 50 may be from a first end portion 5*a* of system 10 to a second end portion 5*b* of system 10 (FIG. 1) defining a longitudinal axis (as defined by arrow X). To describe in a different manner, the article arrays 50 may be transported on a table or platform 24 sequentially from the staging area 12 to the debagging area 14 and then to the article collection area 18. The terms "gripped" and "transported" and "moved" and the like in the context of the interaction between an article array delivery device and the article array(s) may be used interchangeably. Finally, the terms "translated" and "moved" and "pushed" and the like in the context of the movements of the article array(s) may be used interchangeably.

Figure 3:
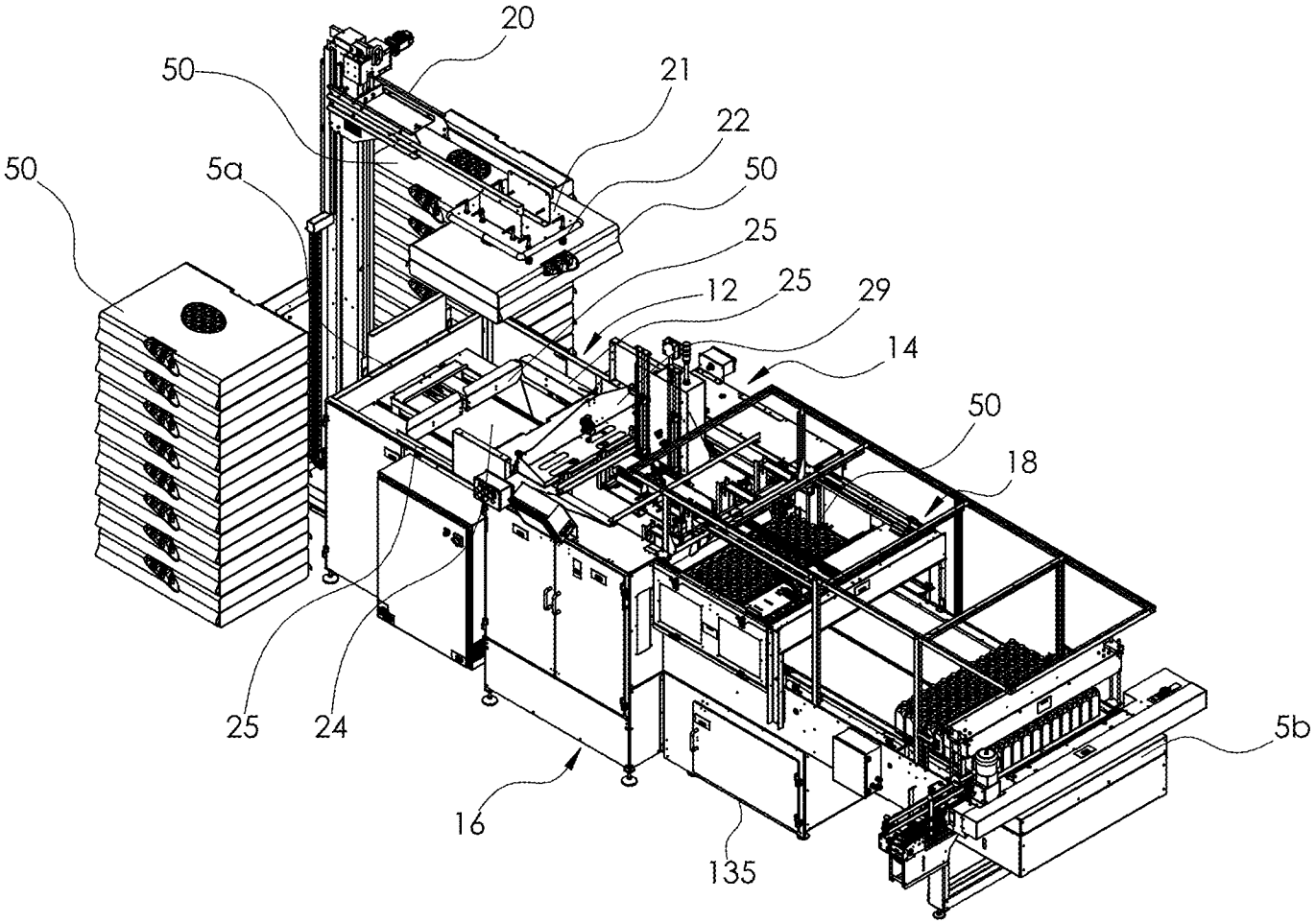
FIG. 3 is an upper perspective view of an exemplary debagging system with an article array delivery system, according to an example embodiment.
Figure 4A:
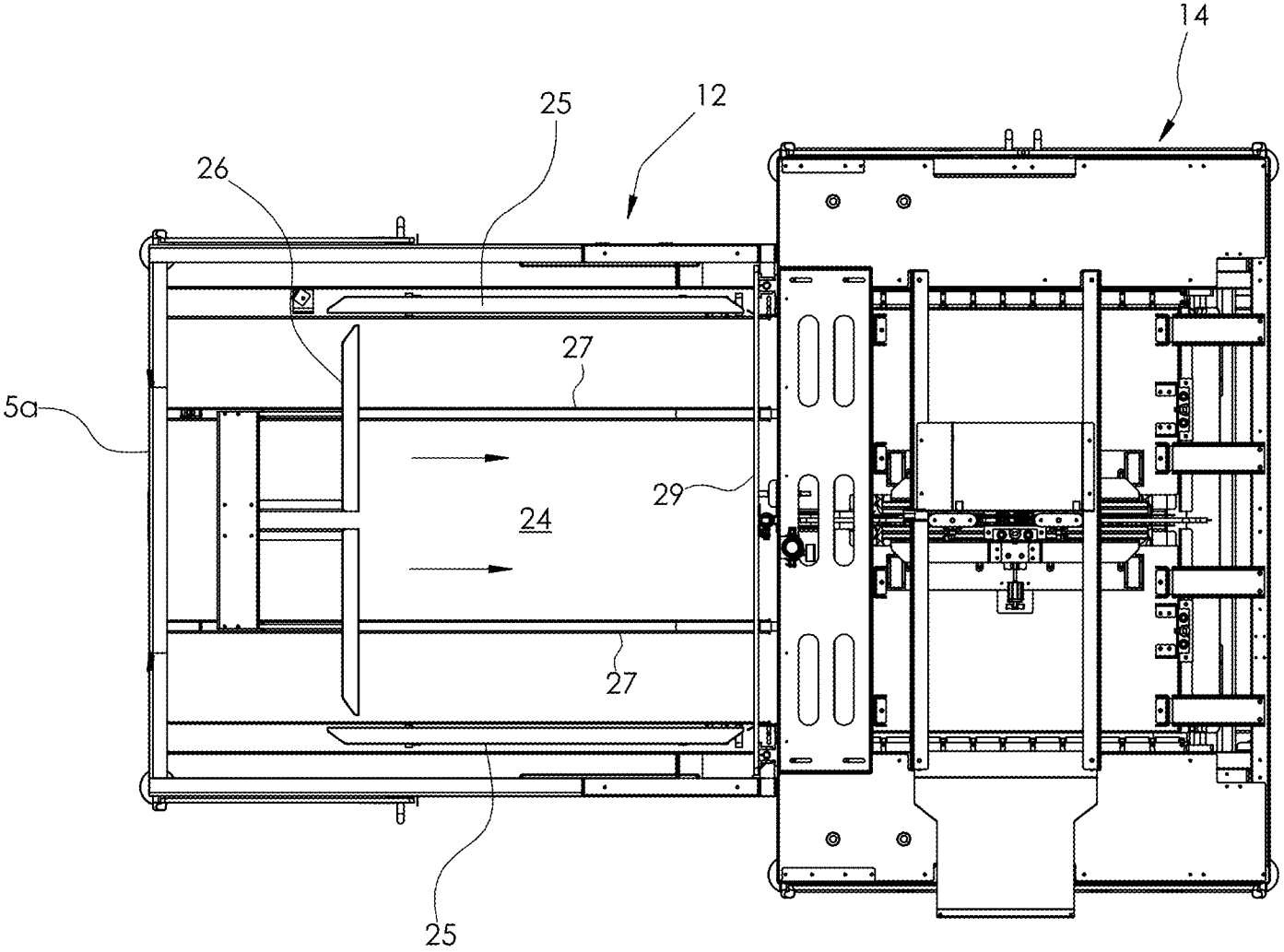
FIGS. 4A-4D are top views of sequential operational movements of a pushing plate in a staging area of the exemplary debagging system of FIG. 1, according to example embodiments.

Referring to FIG. 3, the article array 50 is transported from a stack of article arrays 50 by an article array delivery device 20, e.g., robot, to the table 24 of the staging area 12 for preparing the article array 50 onto the system 10. In one implementation, the article array delivery device 20 includes a head 21 having a plurality of gripping members 22 to engage the packing material 52 from the stack of article arrays 50. The staging area 12 is configured to receive and align the article array 50 for proper alignment. For example, as shown in FIG. 4A, a pair of opposed guide rails 25 located at opposed sides of the system 10 of the staging area 12 can be used to align the article array 50 prior to entering the debagging area 14. Each support rail 25 is configured to translate and engage the article array 50 and align the entire article array 50 in an even configuration, i.e., center of staging area 12, by pushing the respective sides of the article array 50. That is, once the article array 50 is placed in the staging area 12, the pair of opposed support rails 25 moves toward each other, i.e., the longitudinal axis of the system 10, and engages the article array 50 to align the article array 50 for further processing, which will be described later.

Figure 4B:
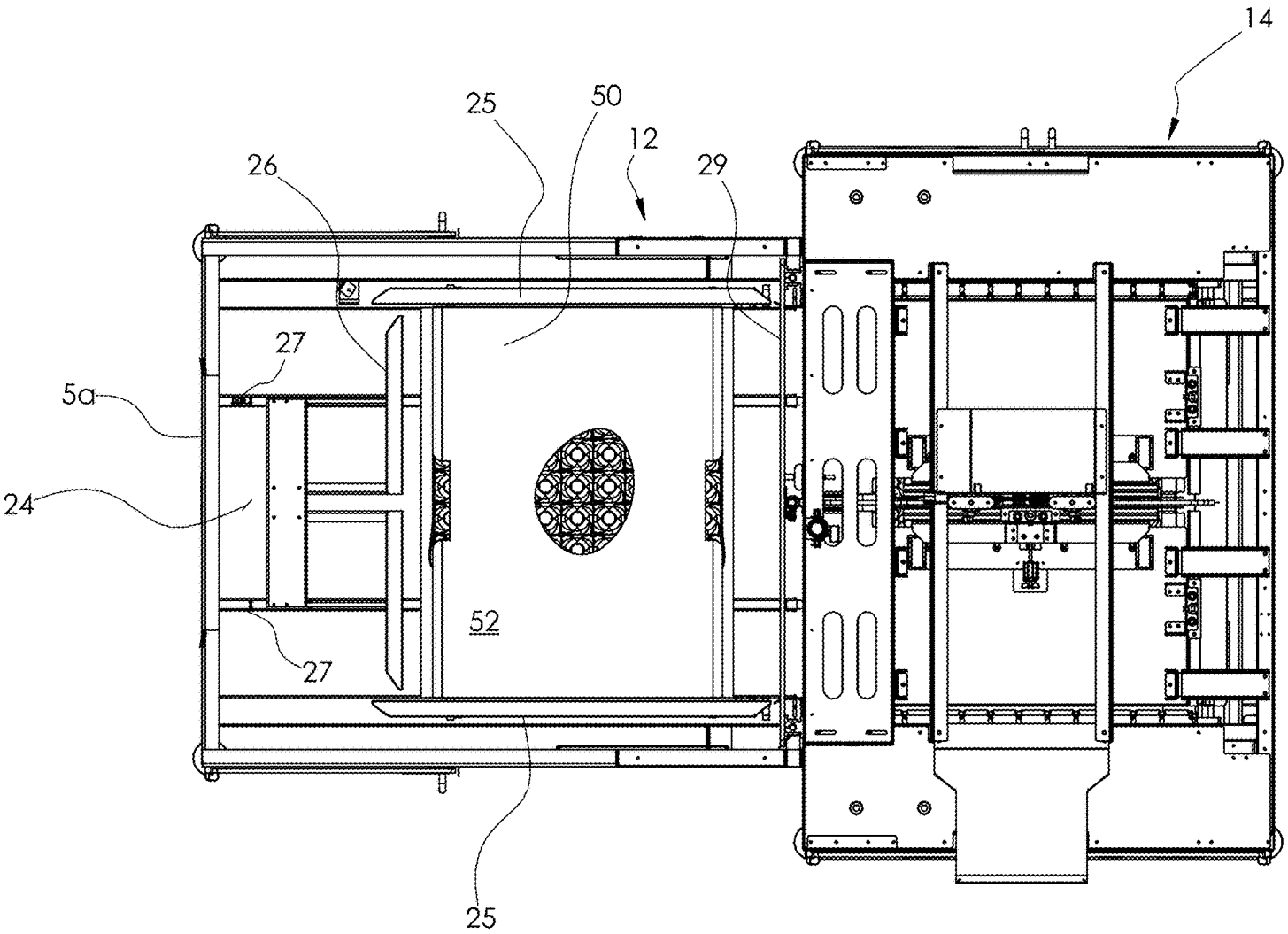
Figure 4C:
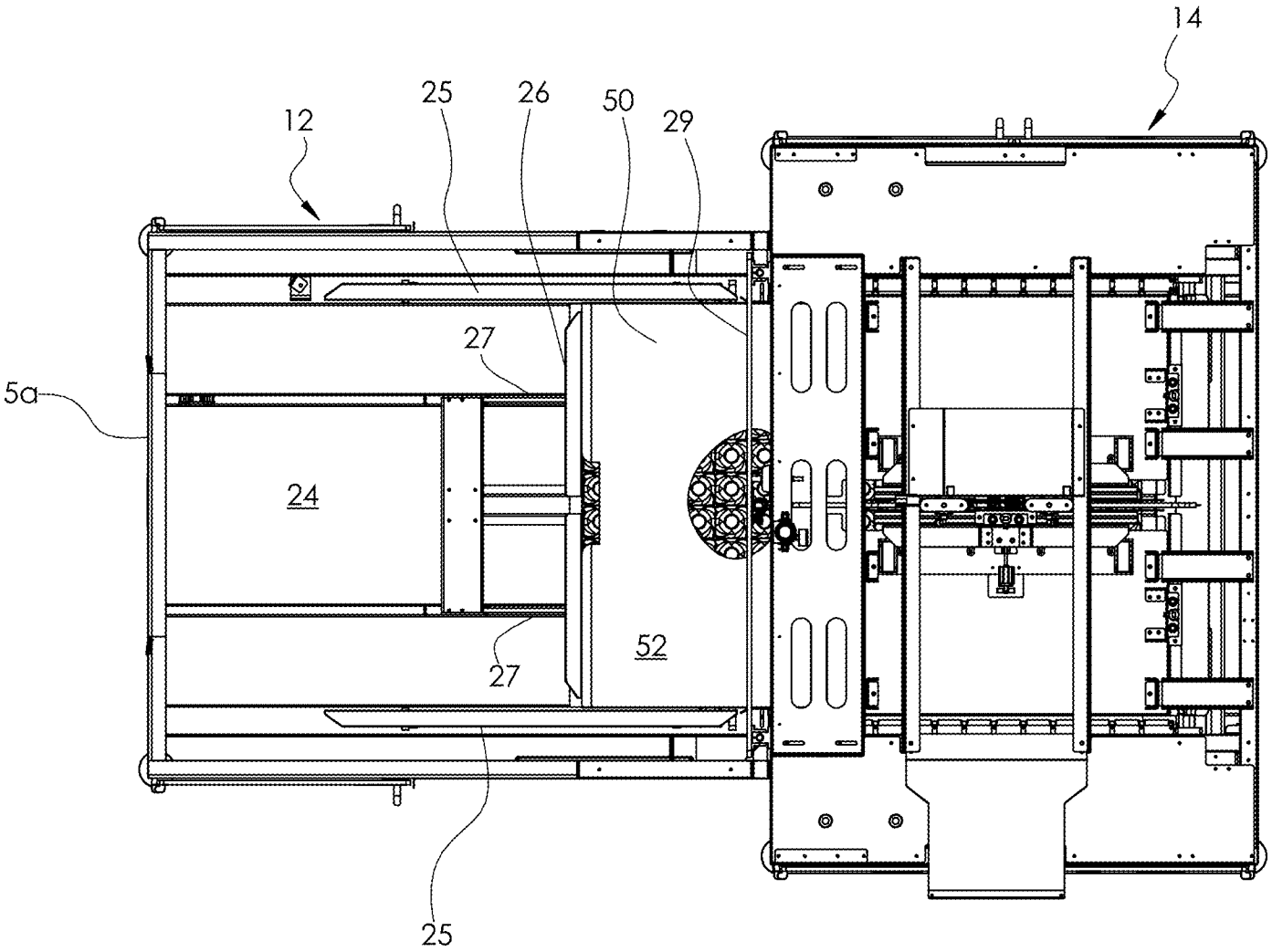
Figure 4D:
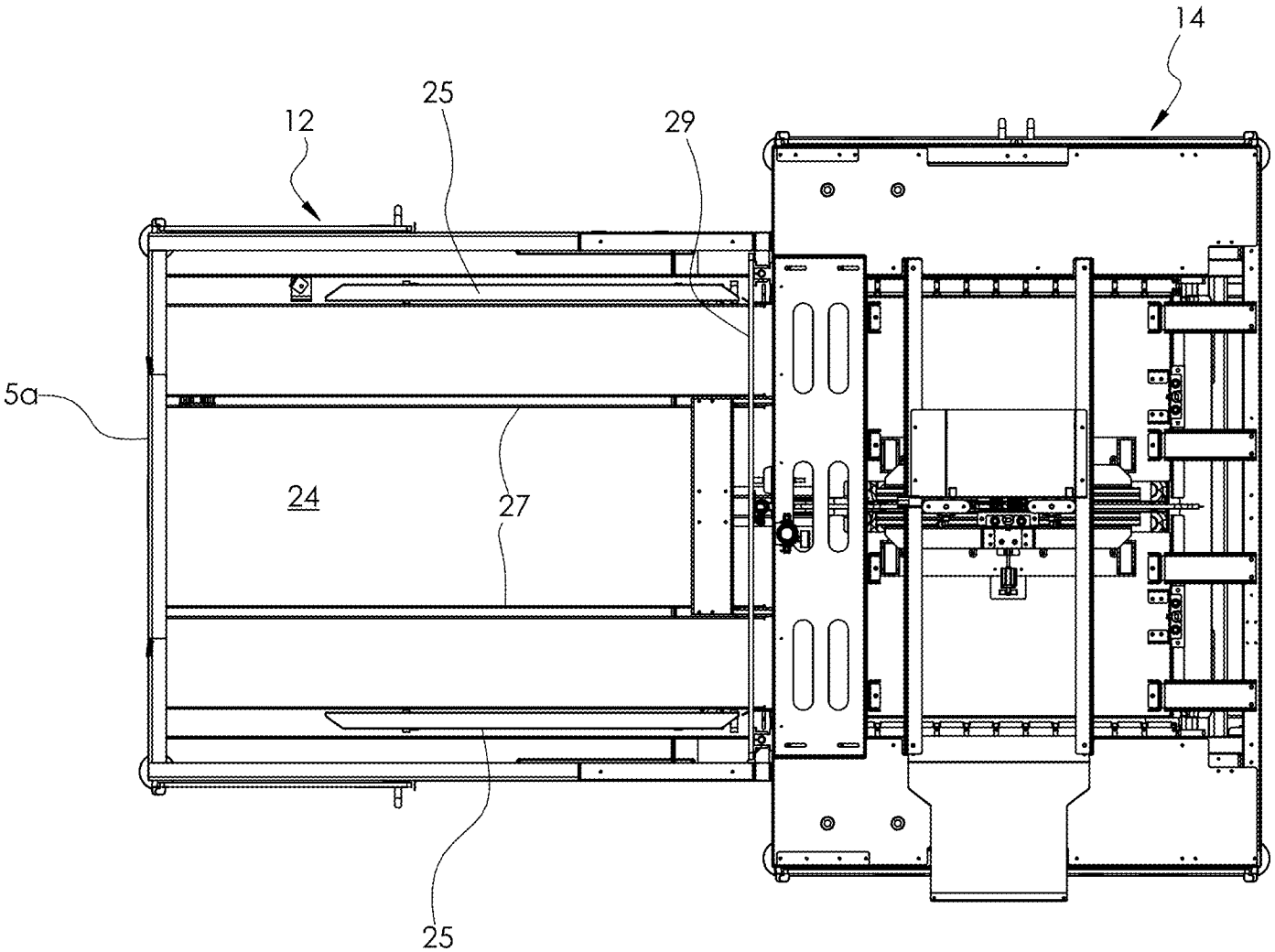

Once the article array 50 is aligned in the staging area 12 via the support rails 25, a pushing plate 26 engages the article array 50 to move along the length direction X of the system 10 (FIG. 4B). This in turn moves the article array 50 towards the debagging area 14 of the system 10. In one implementation, the pushing plate 26 moves along a slot 27 constructed within a surface of the table 24 of the staging area 12. The pushing plate 26 continues to move (i.e., push) the article array 50 until a portion of the article array 50 enters the debagging area 14 (FIG. 4C). That is, the article array 50 is pushed by the pushing plate 26 until a portion of the article array 50 is in a position for initially debagging (i.e., removing) the packing material 52. In other words, the article array 50 is moved into position until the article array 50 is positioned above a cutting device 29 for cutting the packing material 52 in a perpendicular direction with respect to the length direction X.

It is to be understood that the operation and movement of associated components, including the article array delivery device 20, the support rails 25, and/or the pushing plate 26 can be controlled by a processor or control device or controller 100 (FIG. 1), operating in a known manner, and is driven by any appropriate drive mechanism known in the art, and not limited to those disclosed in the exemplary embodiments herein.

In some implementations, sensors (not shown), such as a laser sensor may be employed for determining positional locations of the article array 50. For example, a laser sensor may emit a beam for determining when the article array delivery device 20 properly placed the article array 50 in the staging area 12, for determining when the article array 50 is centered in the staging area 12, for determining when the article array 50 is positioned for cutting, and the like. For purposes herein, sensors are intended to include other types of devices, such as proximity switches that make physical contact with the article array 50, or other suitable position-determining devices or sensors may be used to determine for positional locations.

Figure 6B:
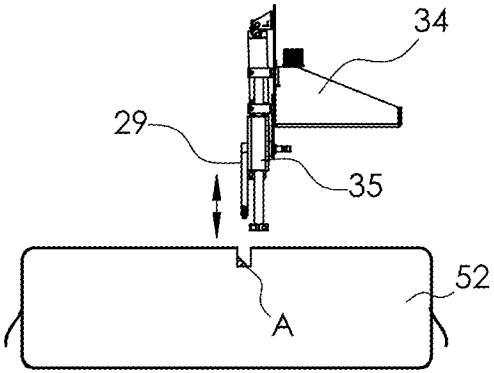
FIG. 6B is a side view of the first cutting device of FIG. 6A, according to an example embodiment.
Figure 6A:
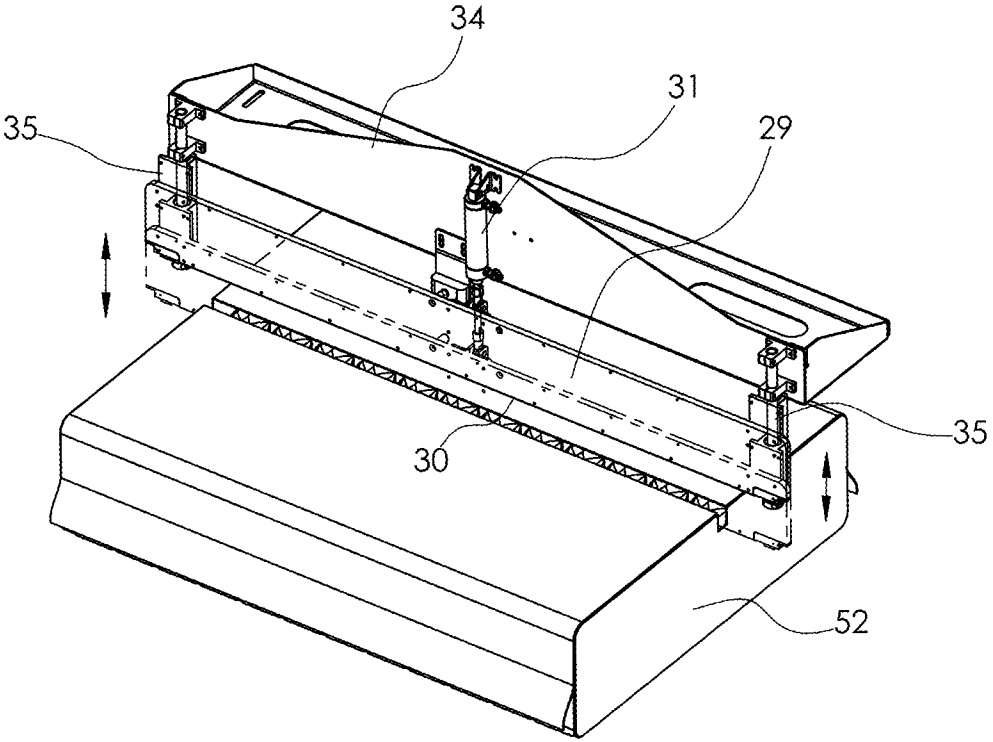
FIG. 6A is a perspective view of a first cutting device in operation, according to an example embodiment.
Figure 6C:
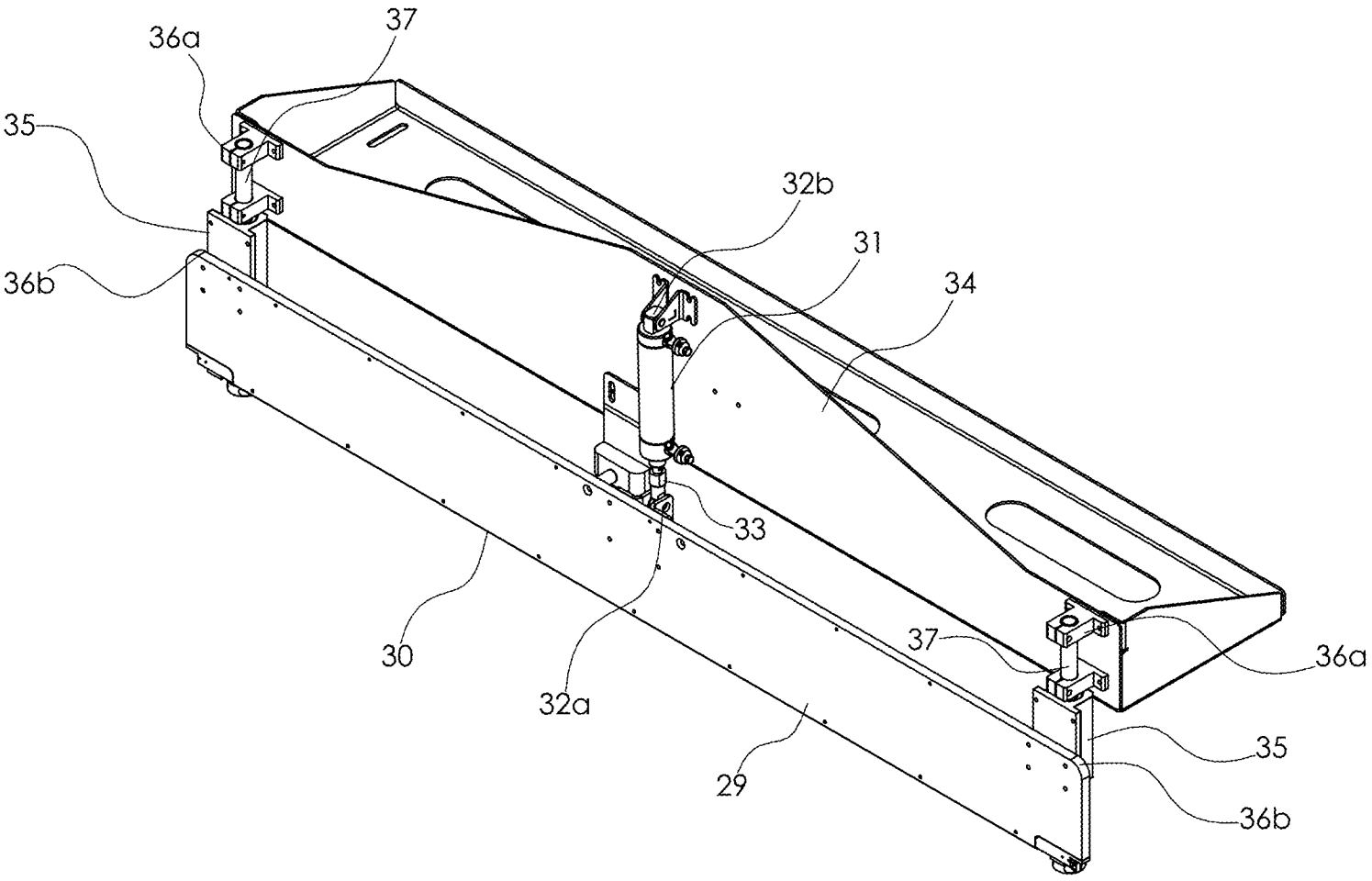
FIG. 6C is a perspective view of a first cutting device, according to an example embodiment.

Referring to FIGS. 6A-6C, the (first) cutting device 29 is now discussed in detail. FIG. 6C is a perspective view of solely the cutting device 29 and a positioner 34 and removed from FIG. 3 for purposes of clarity. As shown, the cutting device 29 extends substantially a length of the table 24 of the staging area 12 corresponding perpendicularly to the length direction of travel of the article array 50, i.e., cross-cut. The cutting device 29 is translatable in a vertical direction (FIG.

6A) to partially cut at least an upper portion of the packing material 52 of the article array 50 (FIG. 6B). In some implementations, the cut made by the cutting device 29 may be at a mid-portion of the article array 50. In other implementations, the cut made by the cutting device 29 may be near at least one edge of the article array 50. In yet other implementations, the cut made by the cutting device 29 can be one or more cuts, e.g., the mid-portion, near one edge and near the other edge of the article array 50. In operation, the user selects or manually enters instructions, via a display 103 controlled by the controller 100, the desired cut(s) made by the cutting device 29 which is dependent upon a shape of the article. For example, an article that is tall may require at least one or more cuts while an article that is short may require only one cut. Further, as shown in FIG. 6B, the cutting device 29 is offset in relation to the positioner 34 in order for the cutting device 29 to vertically move without interfering with the positioner 34. In some implementations, the cutting device 29 has a heatable wire (not shown) on its lower edge 30 to serve as a cutting member. The cutting device 29 is driven by an actuator 31, such as a pneumatic actuator connected to a pressurized air source (not shown) attached at one end 32*a* to the cutting device 29 and to the positioner 34 at the other end 32*b*. A rod 33 is received in the actuator 31 to slidably move in a vertical direction. In response to actuator 31 being urged by the pressurized air source to an extended position, the cutting device 29 moves vertically and toward an upper portion of the article array 50. As the cutting device 29 is urged into contact with the packing material 52 of the article array 50, this results in the packing material 52 being partially cut (as shown by "A") in a cross-direction (i.e., perpendicular) with respect to the length direction (FIG. 6B). As defined herein, the term "partially cut" refers to the packing material 52 being cut at only a (upper) portion of the article array 50 or that the cut does not extend entirely through the packing material 52 of the article array 50. Once the packing material 52 is partially cut, the cutting device 29 is retracted to its initial position, i.e., raised up or lifted by the actuator 31 and transported to the next stage. At each end of the positioner 34 is a stabilizing member 35 to stabilize the cutting device 29 while moving in the extended and retracted positions. One end 36*a* is attached to the positioner 34 and the other end 36*b* is attached to the cutting device 29. The stablishing member 35 includes a rod 37 to slidably move in a vertical direction similar to the rod 33 of the actuator 31.

In some implementations, a suction gripper (not shown) may be employed in conjunction with the cutting device 29. The suction gripper is generally used when an arrangement of rows of articles of the article array are not equivalent, in which the cutting device 29 can possibly interfere or impede with the articles. As such, in order to avoid this interference, the suction gripper grabs and lifts the packing material 52 resulting in the packing material 52 to extend or stretch so that the cutting device 29 can easily cut the packing material 52 without interfering with (i.e., disturbing) the articles. Accordingly, the suction gripper grabs and lifts the packing material 52 while the cutting device 29 partially cuts thereto.

It is to be understood that the operation and movement of associated components of the cutting device 29, including the actuator 31 is controlled by a microprocessor or control unit or controller 100 (FIG. 1), operating in a known manner, and is driven by any appropriate drive mechanism known in the art, and not limited to those disclosed in the exemplary embodiments herein.

Figure 5A:
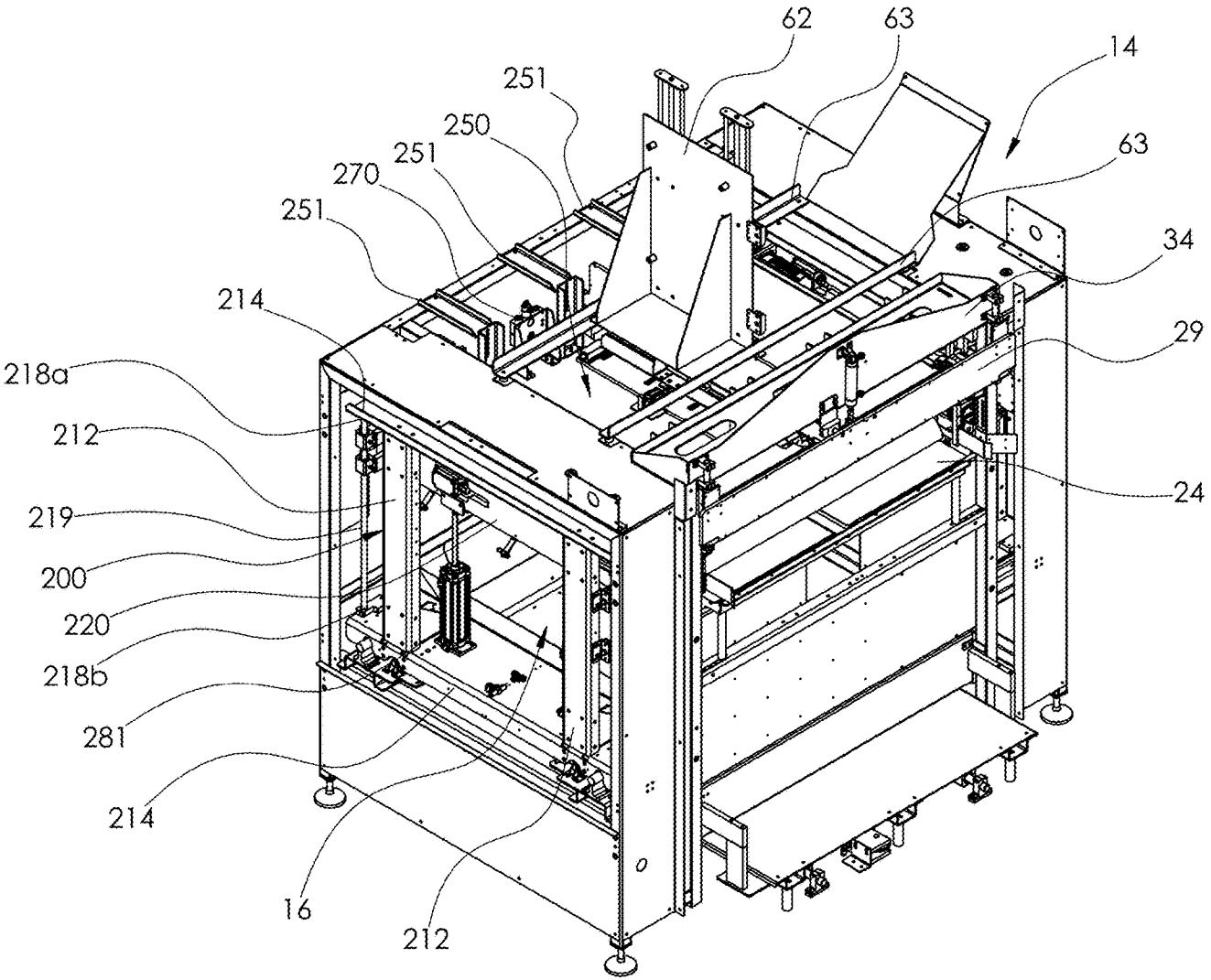
FIG. 5A is a perspective view of a debagging area of the exemplary debagging system of FIG. 1, according to an example embodiment.
Figure 5B:
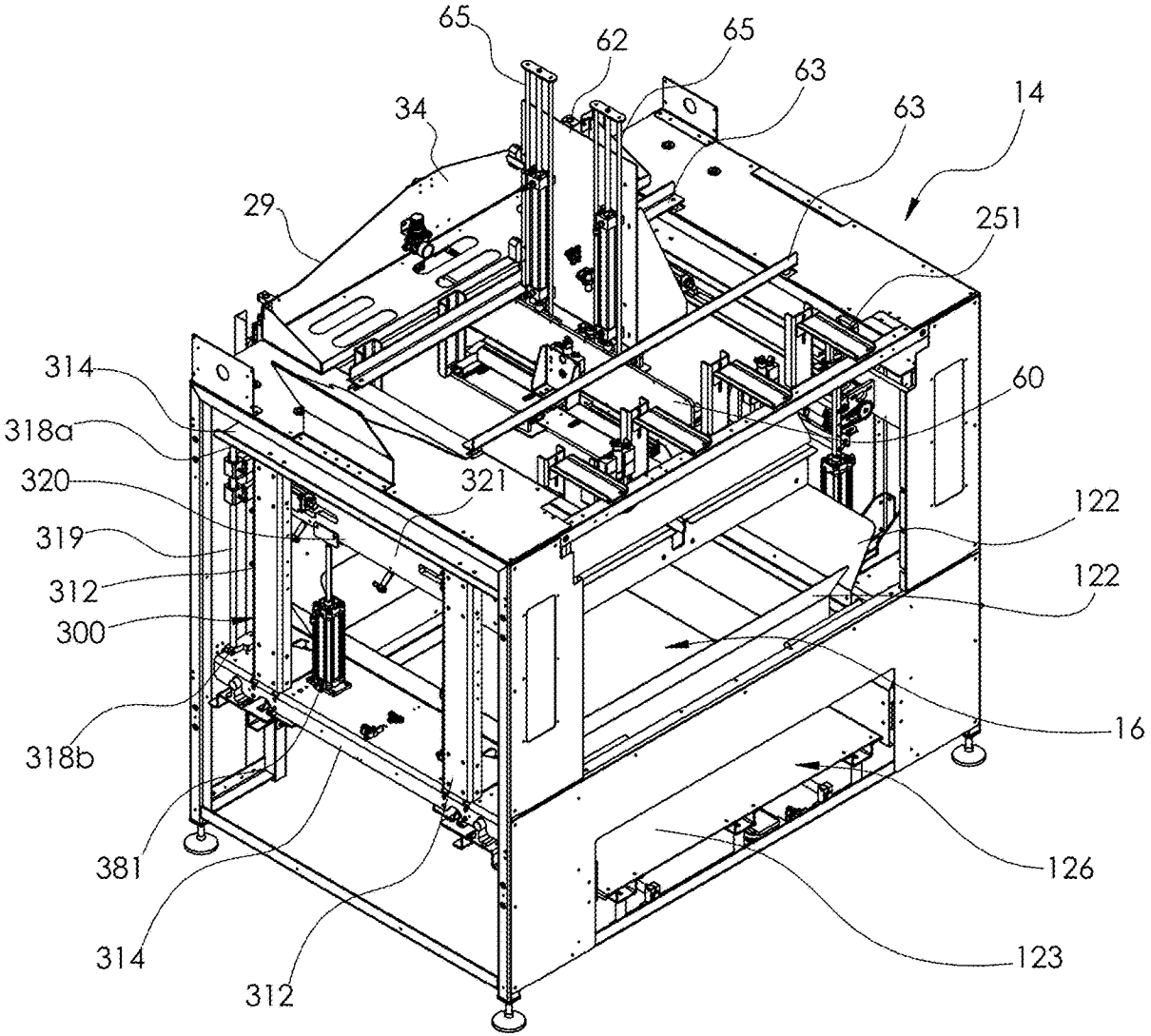
FIG. 5B is an opposite perspective view of the debagging area of FIG. 5A, according to an example embodiment.
Figure 7:
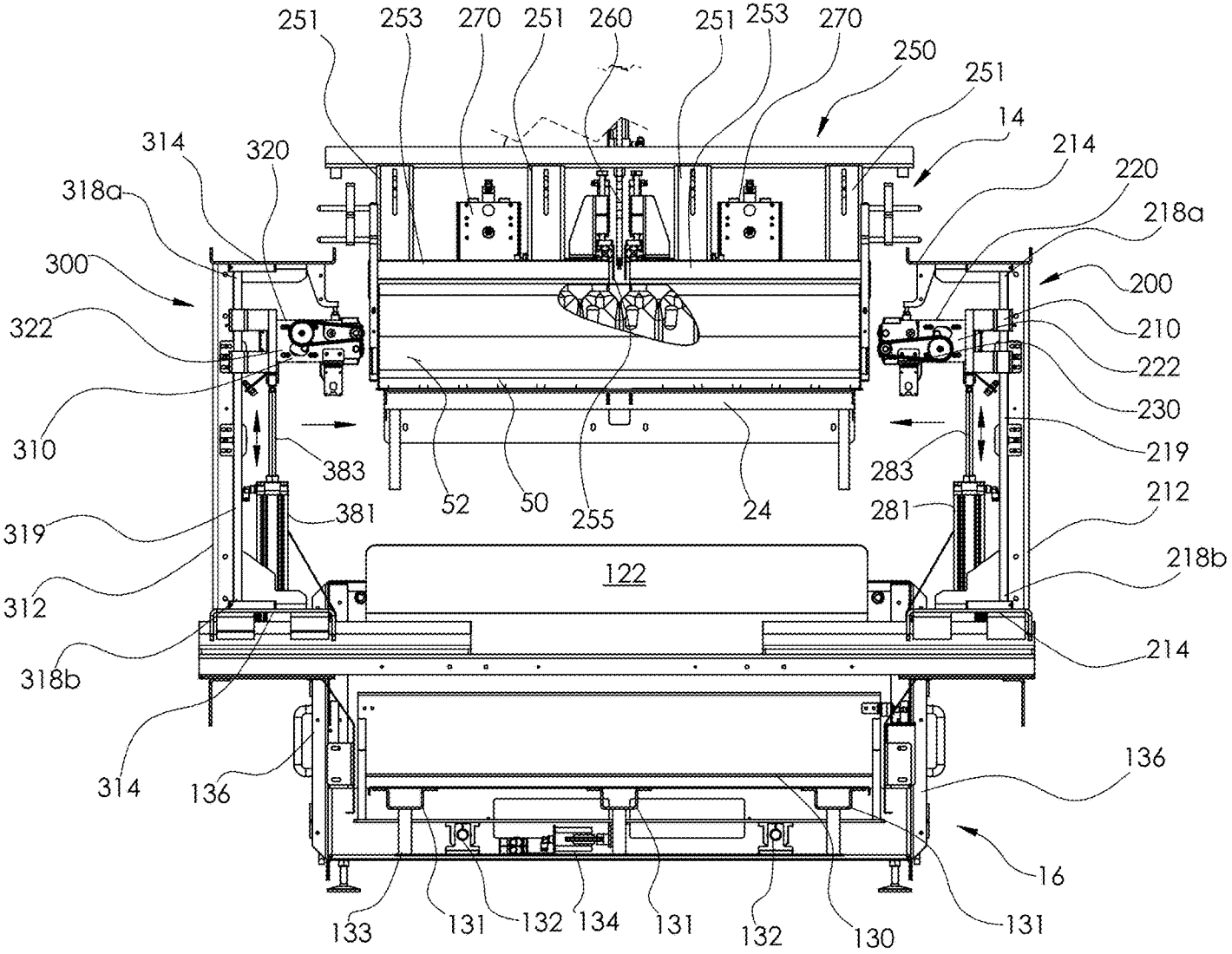
FIG. 7 is a cutaway sectional view of a debagging area of the exemplary debagging system of FIG. 1, according to an example embodiment.

Referring to FIGS. 5A and 5B, once the packing material 52 is partially cut by the cutting device 29, the article array 50 is ready to be transported to the debagging area 14 of the system 10 translated by the pushing plate 26. As alternatively shown in FIG. 4C, the pushing plate 26 pushes the article array 50 into the debagging area 14 where the packing material 52 of the article array 50 is to be removed or stripped. The debagging area 14 includes a first side assembly 200 (FIG. 5A) and a second side assembly 300 (FIG. 5B) disposed opposite to the first side assembly 200 and translatable towards each other (FIG. 7). It should be appreciated that the second side assembly 300 is substantially identical to the first side assembly 200.

Figure 11:
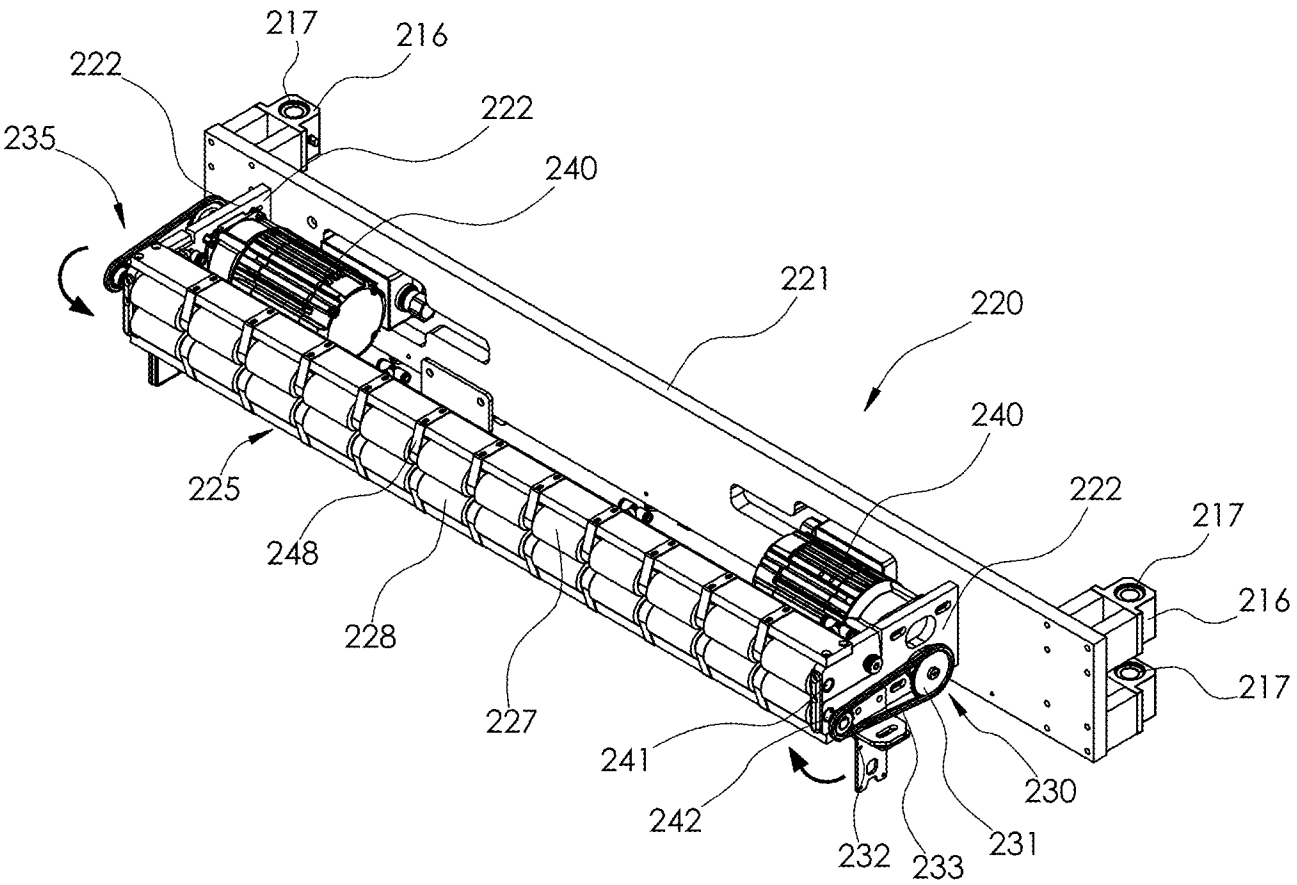
FIG. 11 is a perspective view of a first bag gripping subassembly, according to an example embodiment.
Figure 12A:
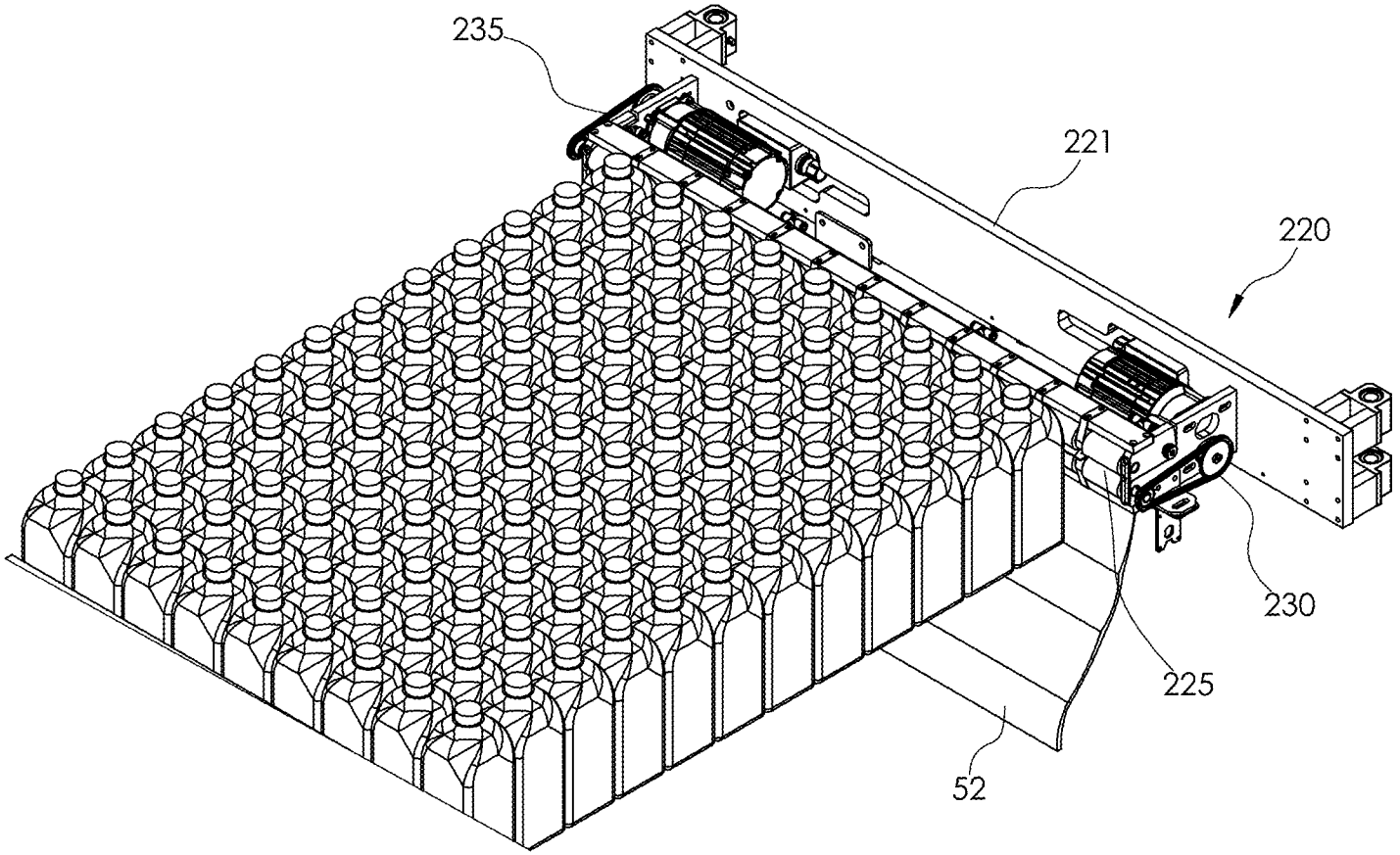
FIGS. 12A and 12B are perspective views of the first bag gripping subassembly of FIG. 11 in operation, according to an example embodiment.
Figure 12B:
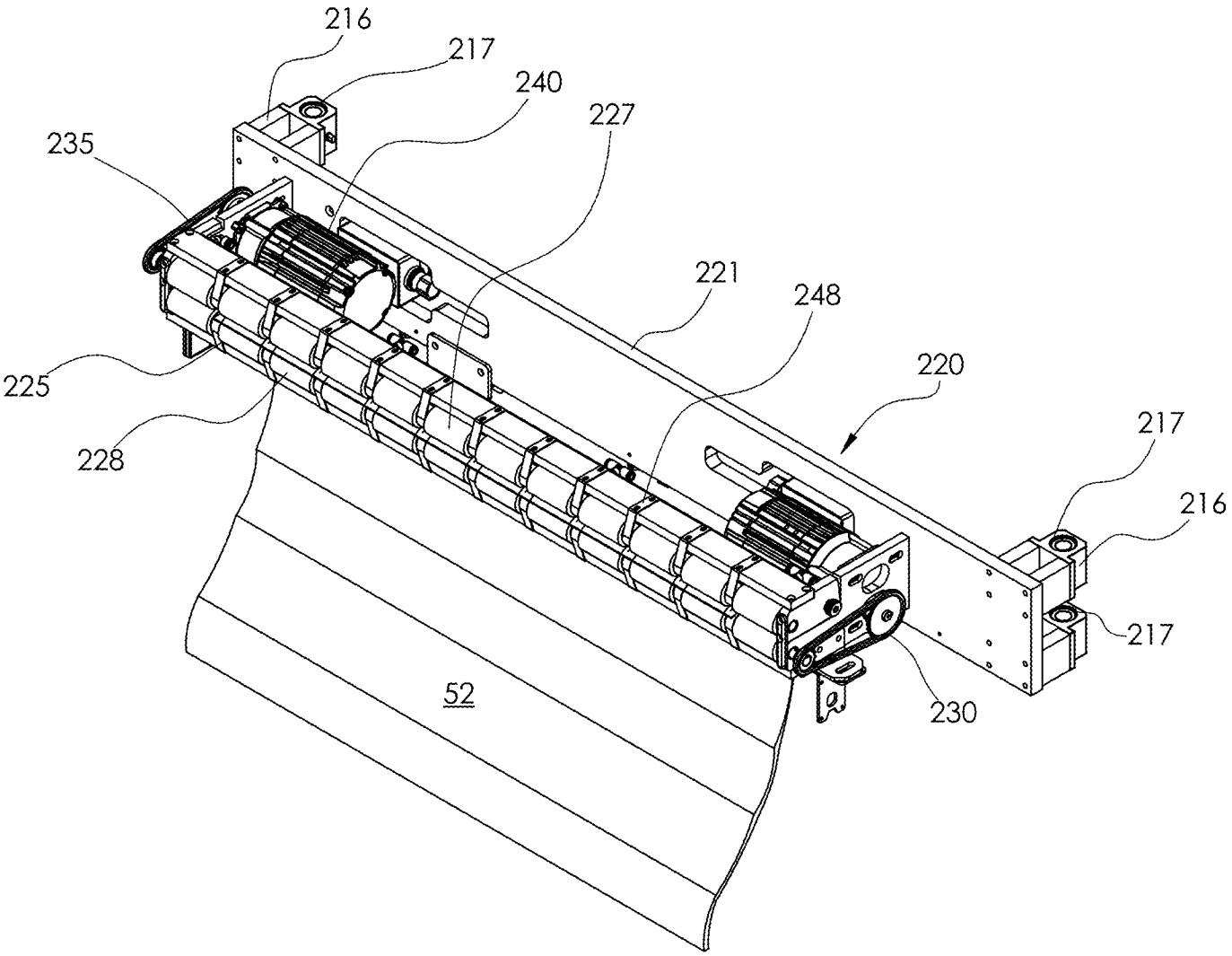

The first side assembly 200 includes a first stripping assembly 210 having a pair of vertical frame members 212 and a pair of horizontal frame members 214 interconnected to each other forming a substantially rectangular-like shape. The first stripping assembly 210 can translate in a horizontal direction towards the article array 50 received in the debagging area 14. Attached to the first stripping assembly 210 is a first bag gripping subassembly 220 designed to engage the packing material 52 of one side of the article array 50. Therefore, since the first bag gripping subassembly 220 is attached to the first stripping assembly 210, in particular, e.g., the pair of vertical frame members 212, the first bag gripping subassembly 220 also horizontally moves towards the article array 50 for gripping or stripping the packing material 52 of the article array 50. For additional movement, the first bag gripping subassembly 220 is slideably engaged, via a support member 216 (FIG. 11), to a vertical cylinder guide 219, which extends vertically between the pair of horizontal frame members 214. More specifically, as shown in FIG. 7, one end 218*a* of the vertical cylinder guide 219 is attached to an upper horizontal frame member 214 and the other end 218*b* of the vertical cylinder guide 219 is attached to a lower horizontal frame member 214, whereby the first bag gripping subassembly 220 is configured to engage and vertically slide on the vertical cylinder guide 219 via a plurality of openings 217 of the support member 216. The first bag gripping subassembly 220 is driven by an actuator 281, such as a pneumatic cylinder connected to a pressurized air source (not shown) attached at one end to the lower horizontal frame 214 and to the first bag gripping subassembly 220 at the other end. A rod 283 is received in the pneumatic cylinder 281 to slidably move in a vertical direction. In I response to the pneumatic cylinder 281 being urged by the pressurized air source to an extended position, the first bag gripping subassembly 220 moves vertically upwards toward the table 24. Conversely, when the pneumatic cylinder 281 is at a retracted position, the first bag gripping subassembly 220 moves vertically downwards away from the table 24. Further, as defined herein, the extended position represents the first bag gripping subassembly 220 in its operational state while the retracted position represents the first bag gripping subassembly 220 in its unoperational state, i.e., power off. As a result, the first bag gripping subassembly 220 in its retracted position provides a clearance to remove any impedance or debris and/or reduces malfunctions, i.e., jamming. Referring to FIG. 11, the first bag gripping subassembly 220 has, mounted at each end thereof and attached to the first stripping assembly 210, a support plate 221 supporting a first gripper 225. The first gripper 225 is attached between end plates 222 mounted to the support plate 221. Each end plate 222 contains a roller drive apparatus 230 driven by a motor 240, e.g., AC motor, DC motor, or servo motor. The roller drive apparatus 230 can include a large sprocket 231, a small sprocket 232, a chain or belt 233, and the like (i.e., gears, actuator), to operate the roller drive apparatus 230. The first gripper 225 includes a plurality of top rollers 227 disposed horizontally between the end plates 222 and rigidly attached at each end thereto, by a shaft 241. Disposed horizontally and in parallel to the plurality of top rollers 227, a plurality of bottom rollers 228 rigidly attached at the respective end plates 222, by a shaft 242. In one implementation, shaft 242 is driven by the roller drive apparatus 230 and shaft 241 is driven by a roller drive apparatus 235. To describe differently, the plurality of bottom rollers 228 is driven by the roller drive apparatus 230 and the plurality of top rollers 227 is driven by the roller drive apparatus 235. Each roller 227, 228 is cylindrical and preferably of a high friction material, for example, but not limited to, polyvinyl chloride (PVC). In use, the bottom rollers 228 rotate in a first direction (i.e., clockwise) and engages with the top rollers 227 rotating in a second direction (i.e., counter-clockwise), opposite the first direction, creating a grabbing effect of the packing material 42 when in direct contact thereof. Provided between each roller 227, 228 is an anti-wind device 248 to prevent the packing material 52 from getting caught (i.e., jammed, stuck, trapped) or wrapped around the respective rollers 227, 228.

Referring back to FIGS. 5A and 7, the second side assembly 300 is substantially identical to the first side assembly 200. Similarly, the second side assembly 300 includes a second stripping assembly 310 having a pair of vertical frame members 312 and a pair of horizontal frame members 314 interconnected to each other forming a substantially rectangular-like shape. The second stripping assembly 310 can translate in a horizontal direction towards the article array 50 received in the debagging area 14. Attached to the second stripping assembly 310 is a second bag gripping subassembly 320 designed to engage the packing material 52 of one side of the article array 50. Therefore, since the second bag gripping subassembly 320 is attached to the second stripping assembly 310, in particular, e.g., the pair of vertical frame members 312, the second bag gripping subassembly 320 also horizontally moves towards the article array 50 for gripping or stripping the packing material 52 of the article array 50. For additional movement, the second bag gripping subassembly 320 is slideably engaged to a vertical cylinder guide 319, which extends vertically between the pair of horizontal frame members 314. More specifically, as shown in FIG. 7, one end 318*a* of the vertical cylinder guide 319 is attached to an upper horizontal frame member 314 and the other end 318*b* of the vertical cylinder guide 319 is attached to the (lower) horizontal frame member 314, whereby the second bag gripping subassembly 320 is configured to engage and vertically slide on the vertical cylinder guide 319. As described above respect to the first bag gripping subassembly 220, the second bag gripping subassembly 320 similarly includes a support member (similar to 216) with a plurality of openings (similar to 217) for slideably engaging the vertical cylinder guide 319. Also similarly, the second bag gripping subassembly 320 is driven by the pneumatic cylinder 381 attached at one end to the lower horizontal frame 314 and to the second bag gripping subassembly 320 at the other end. A rod 383 is received in the pneumatic cylinder 381 to slidably move in a vertical direction. In response to the pneumatic cylinder 381 being urged by the pressurized air source to an extended position, the second bag gripping subassembly 320 moves vertically upwards toward the table 24. Conversely, when the pneumatic cylinder 381 is at a retracted position, the second bag gripping subassembly 320 moves vertically downwards away from the table 24. As defined herein, the extended position represents the second bag gripping subassembly 320 in its operational state while the retracted position represents the second bag gripping subassembly 320 in its unoperational state, i.e., power off. It should be appreciated that the operation of the first and second bag gripping subassemblies 220, 320 is operated at the same time or concurrently.

The second bag gripping subassembly 320 similarly includes a support plate (similar to 220) supporting a second gripper 325 that is mounted thereof at end plates 222 driven by roller drive apparatuses 230, 235. It should be appreciated that the second gripper 325 is substantially identical to the first gripper 225 and will not be discussed in detail herein.

It is to be understood that the operation and movements of associated components of the first and second stripping assemblies 210, 310, including at least the first and second bag gripping subassemblies 220, 320 with the respective actuators are controlled by a microprocessor or control unit or controller 100 (FIG. 1), operating in a known manner, and is driven by any appropriate drive mechanism known in the art, and not limited to those disclosed in the exemplary embodiments herein.

Referring back to FIG. 7, the debagging area 14 includes a neck rail assembly 250 disposed at an upper portion thereof. The neck rail assembly 250 is supported by a plurality of of supports 251 mounted to the debagging area 14 of system 10. In one implementation, there may be four supports 251 at each side thereof mounted to the system 10. The neck rail assembly 250 contains a pair of neck rail platforms 253 to allow a pair of neck rails 255 and a (second) cutting device 60 to extend between and through the two neck rail platforms 253, which will be described further in detail later.

Figure 14:
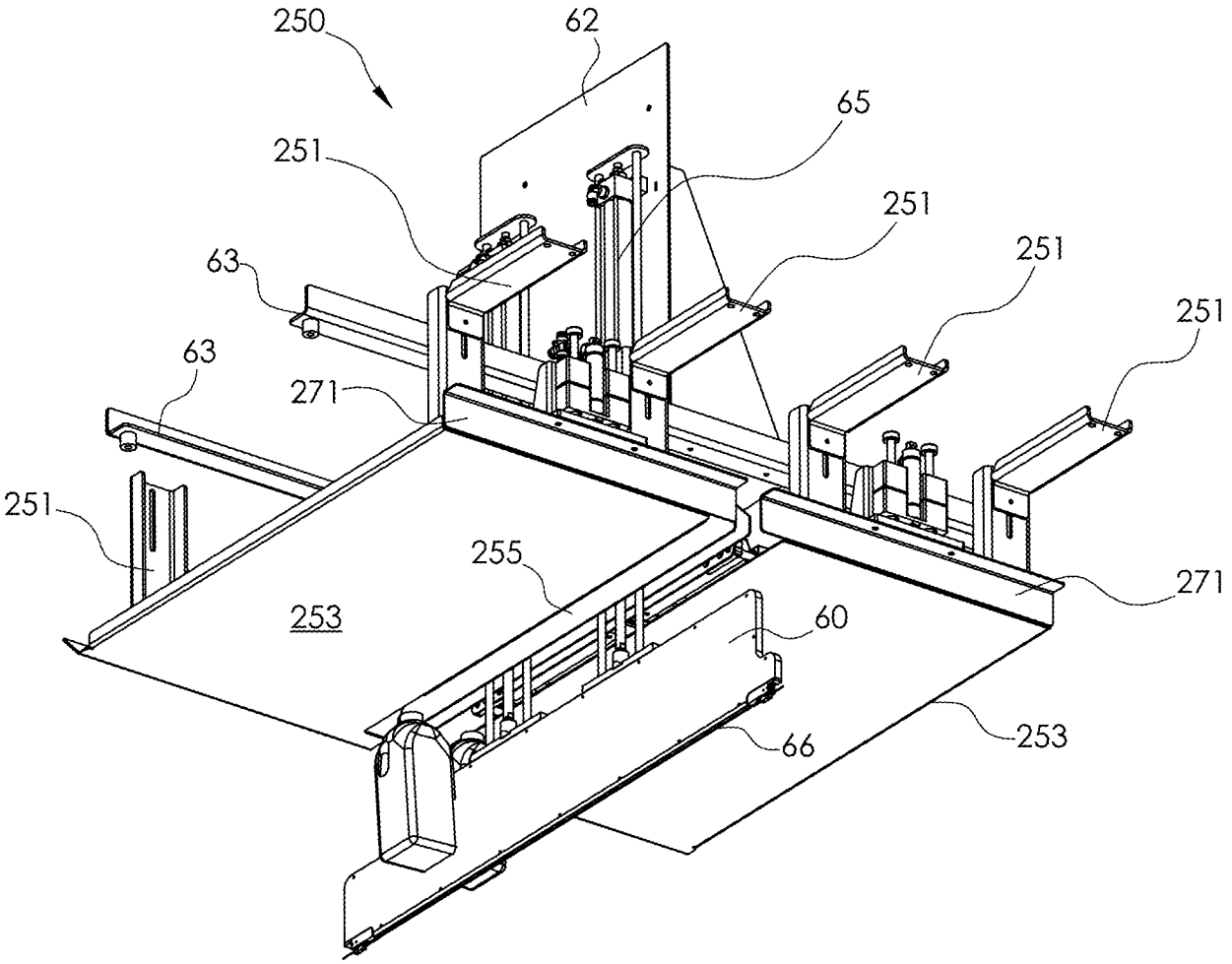
FIG. 14 is a lower perspective view of a neck rail assembly, according to an example embodiment.

Referring to FIGS. 5B and 14, the cutting device 60 is mounted to a support member 62 attached at the upper portion of the debagging area 14 via support rails 63. The cutting device 60 vertically descends (translate) towards the article array 50 received in the debagging area 10 of the system 10 for performing a (second) cut. The cutting device 60 moves along a track 65 in a vertical configuration mounted to the support member 62. The cutting device 60 is driven by an actuator (not shown), such as a pneumatic actuator connected to a pressurized air source. In response to actuator being urged by the pressurized air source to an extended position, the cutting device 60 moves vertically and toward the article array 50 to cut therethrough.

Figure 15:
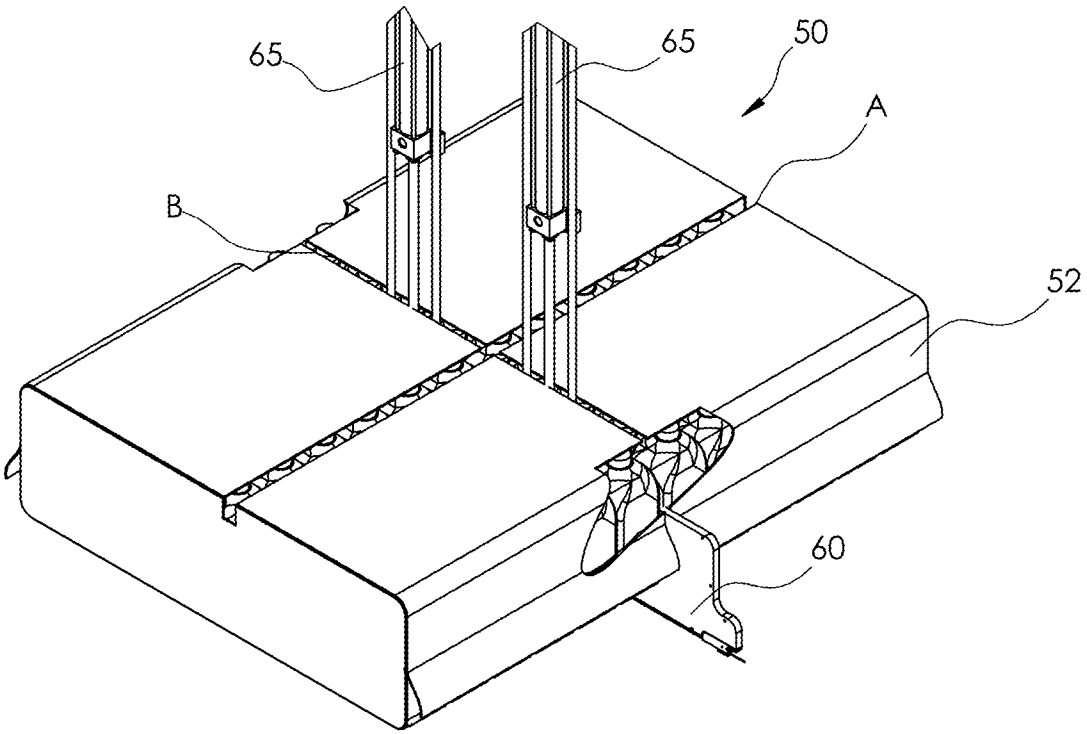
FIG. 15 is a perspective view of an article array that has been cut, according to an example embodiment.

As shown, the cutting device 60 extends substantially in a length direction of table 24 corresponding substantially in the same length direction of travel of the article array 50. In some implementations, the cutting device 60 has a heatable wire (not shown) on its lower edge 66 to serve as a cutting member. As the cutting device 29 is urged into contact with the packing material 52 of the article array 50, this results in the packing material 52 being cut entirely therethrough along the same direction as the longitudinal axis X of the system 10 in approximately a mid-portion of the article array 50. As shown in FIG. 15, the (second) cut (as shown by "B") made by cutting device 60 is in a cross-direction (i.e., perpendicular) with respect to the first cut (as shown by "A") made by the (first) cutting device 29. This results in the packing material 52 being cut into at least two sections allowing the packing material 52 to be easily grabbed and removed by the first and second grippers 225, 325. The two partitioned packing material 52 also ensures that the first and second grippers 225, 325 will not malfunction with respect to the packing material 52, i.e., jammed, stuck, trapped, etc. Once the packing material 52 is cut, the cutting device 60 is retracted to its initial position, i.e., lifted, and waits for the next article array 50 to be cut.

It is to be understood that the operation and movements of associated components of the second cutting device 60 is controlled by a microprocessor or control unit or controller 100 (FIG. 1), operating in a known manner, and is driven by any appropriate drive mechanism known in the art, and not limited to those disclosed in the exemplary embodiments herein.

Referring to FIGS. 10A-10D, the neck rail assembly 250 includes the pair of neck rails 255 that are configured to move in a downward vertical direction and then in a side-outward horizontal direction to create spacing between two adjacent rows of bottles in the article array 50. As described herein, the term "inward" direction is described as lateral movement moving closer to a center of table 24, and the term "outward" direction is described as lateral movement moving farther from the center of table 24.

Figure 9:
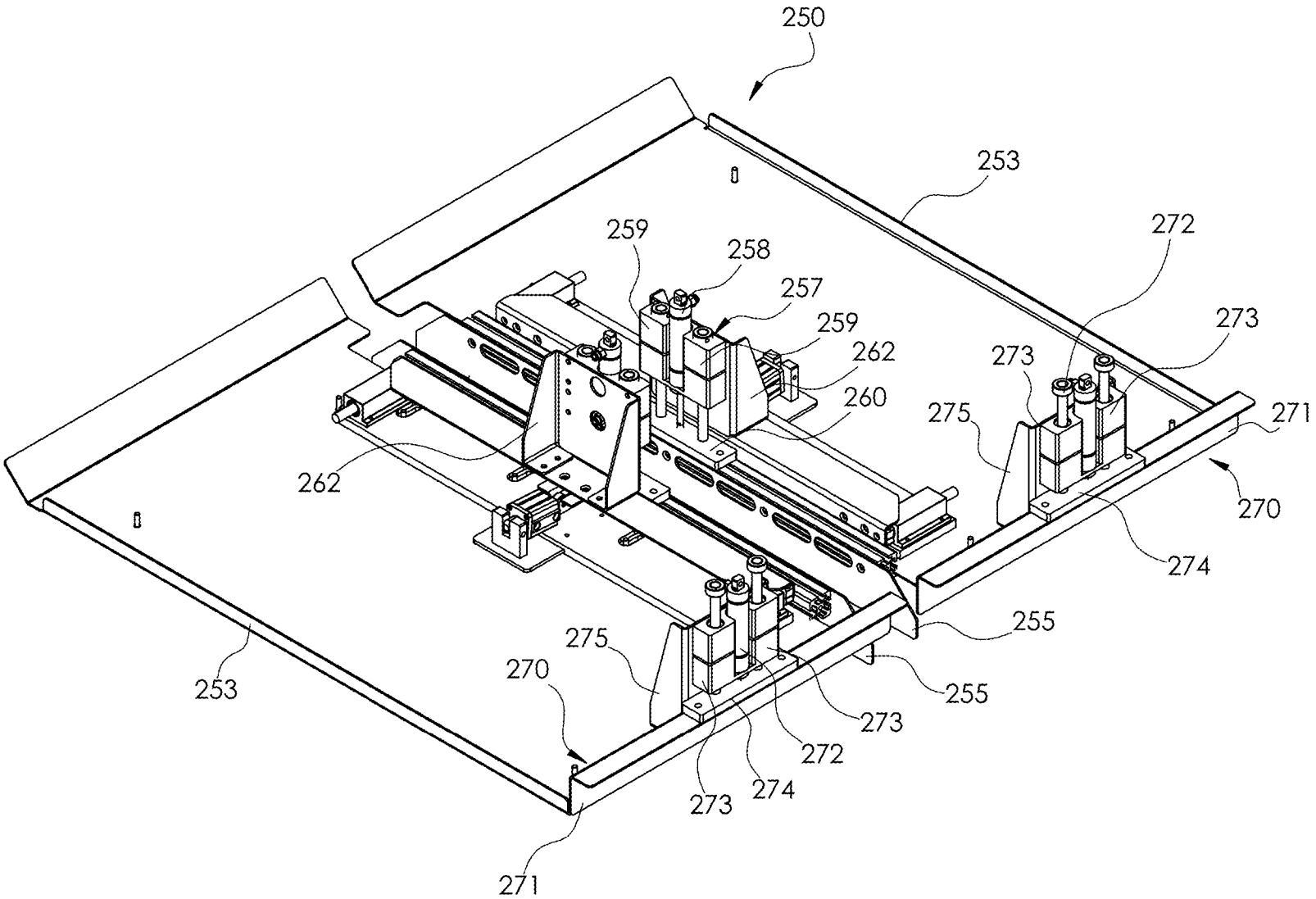
FIG. 9 is a perspective view of a neck rail assembly, according to an example embodiment.
Figure 10A:
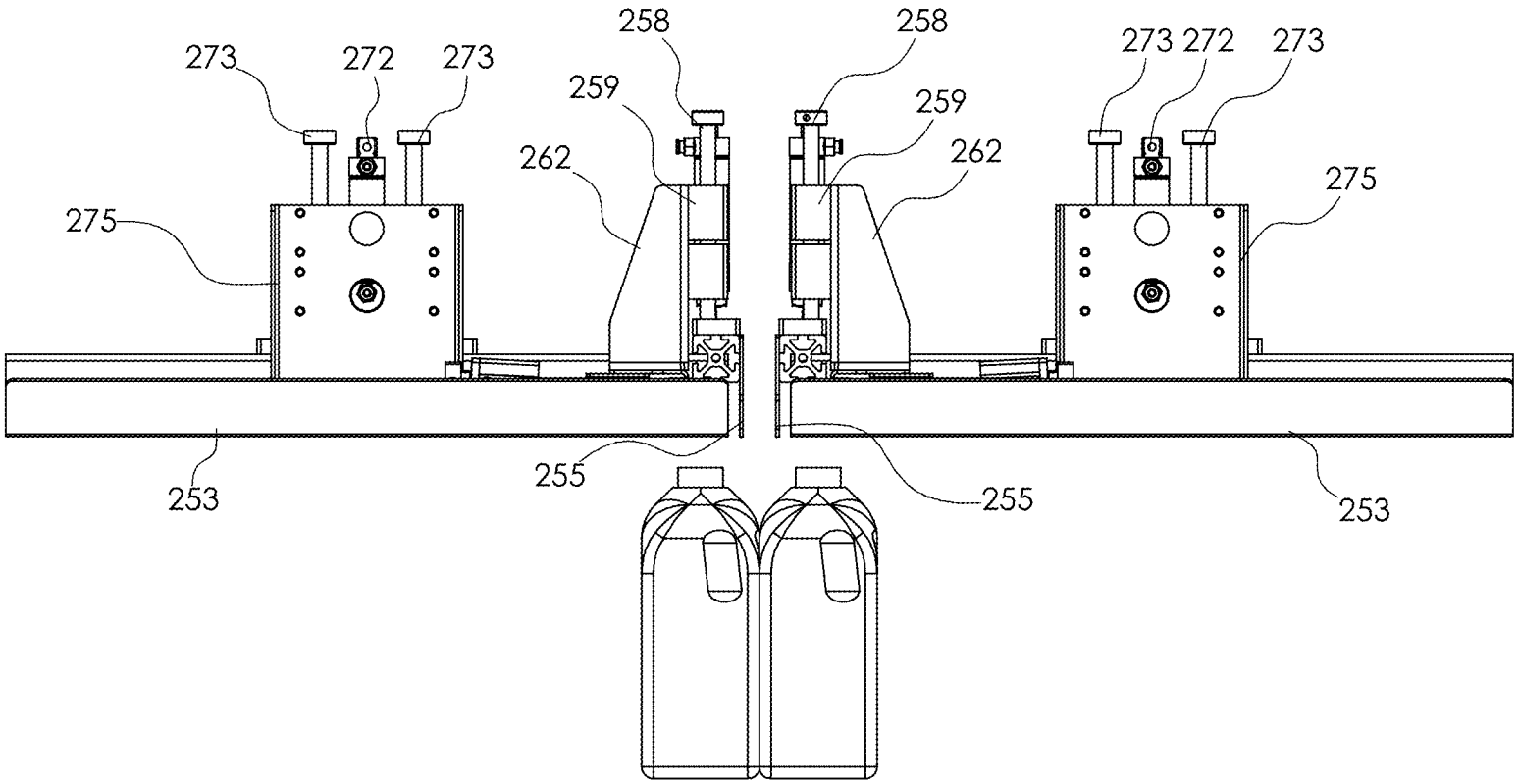
FIGS. 10A-10D are sequential operational movements of a neck rail assembly, according to example embodiments.
Figure 10B:
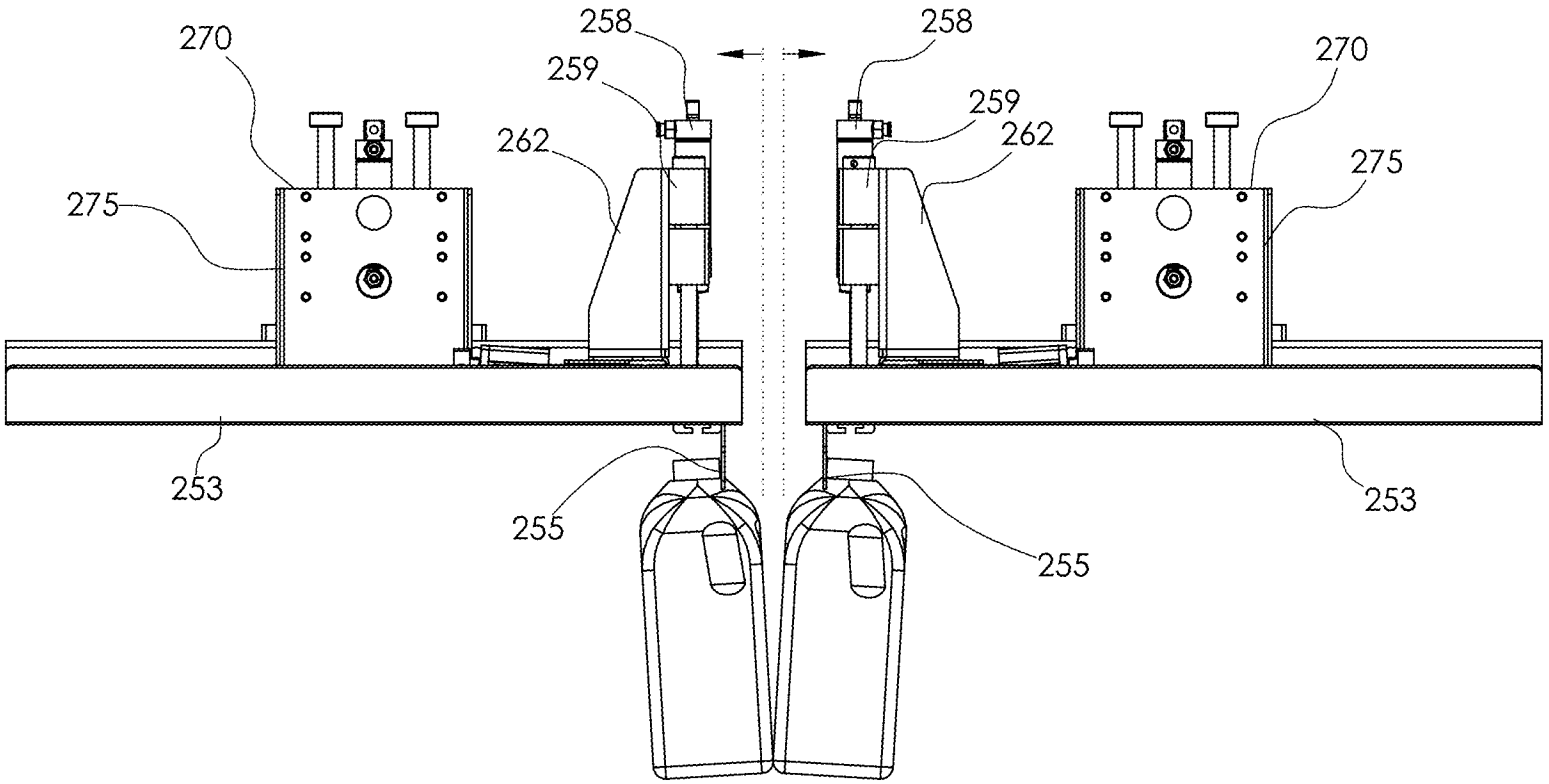
Figure 10C:
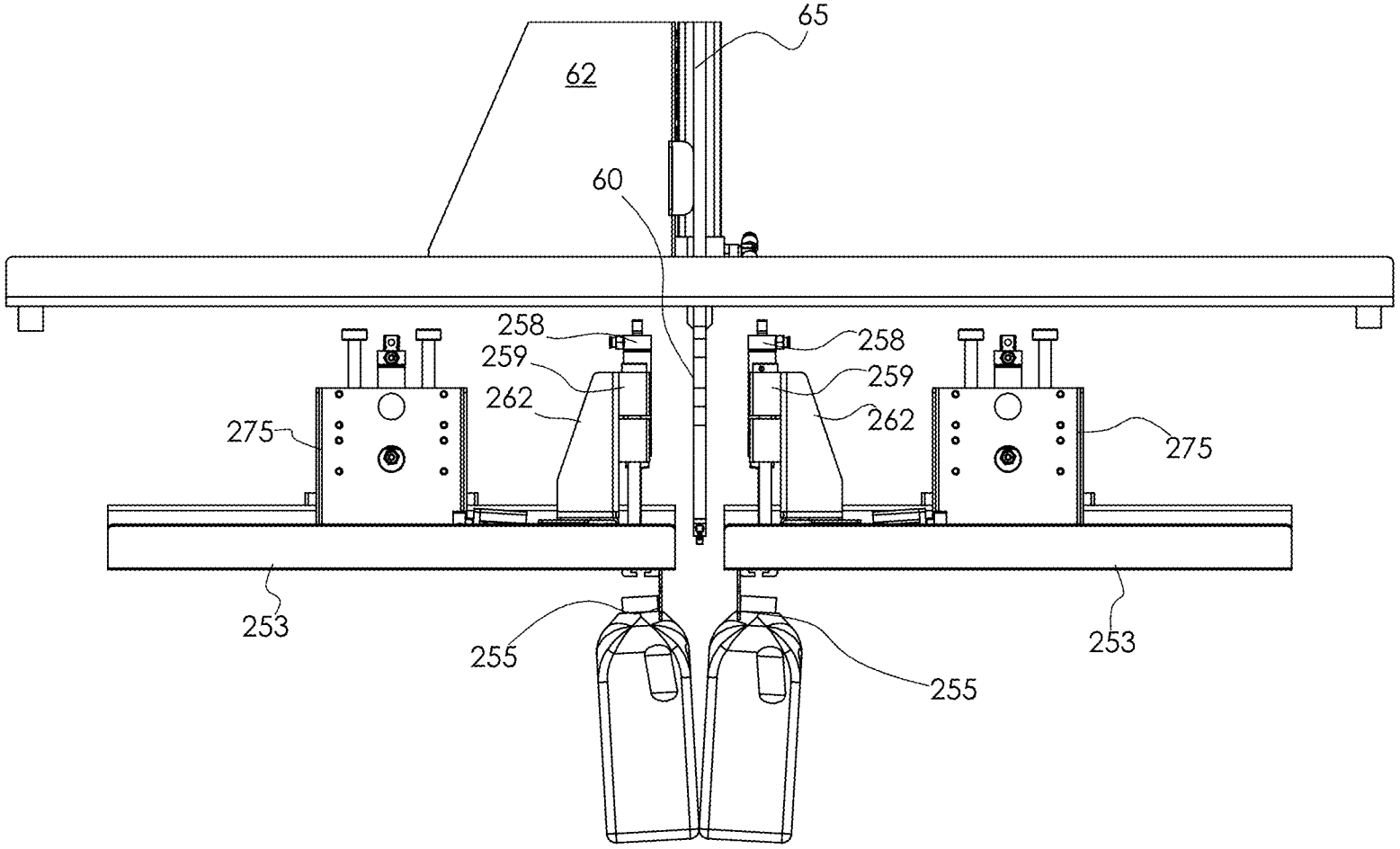
Figure 10D:
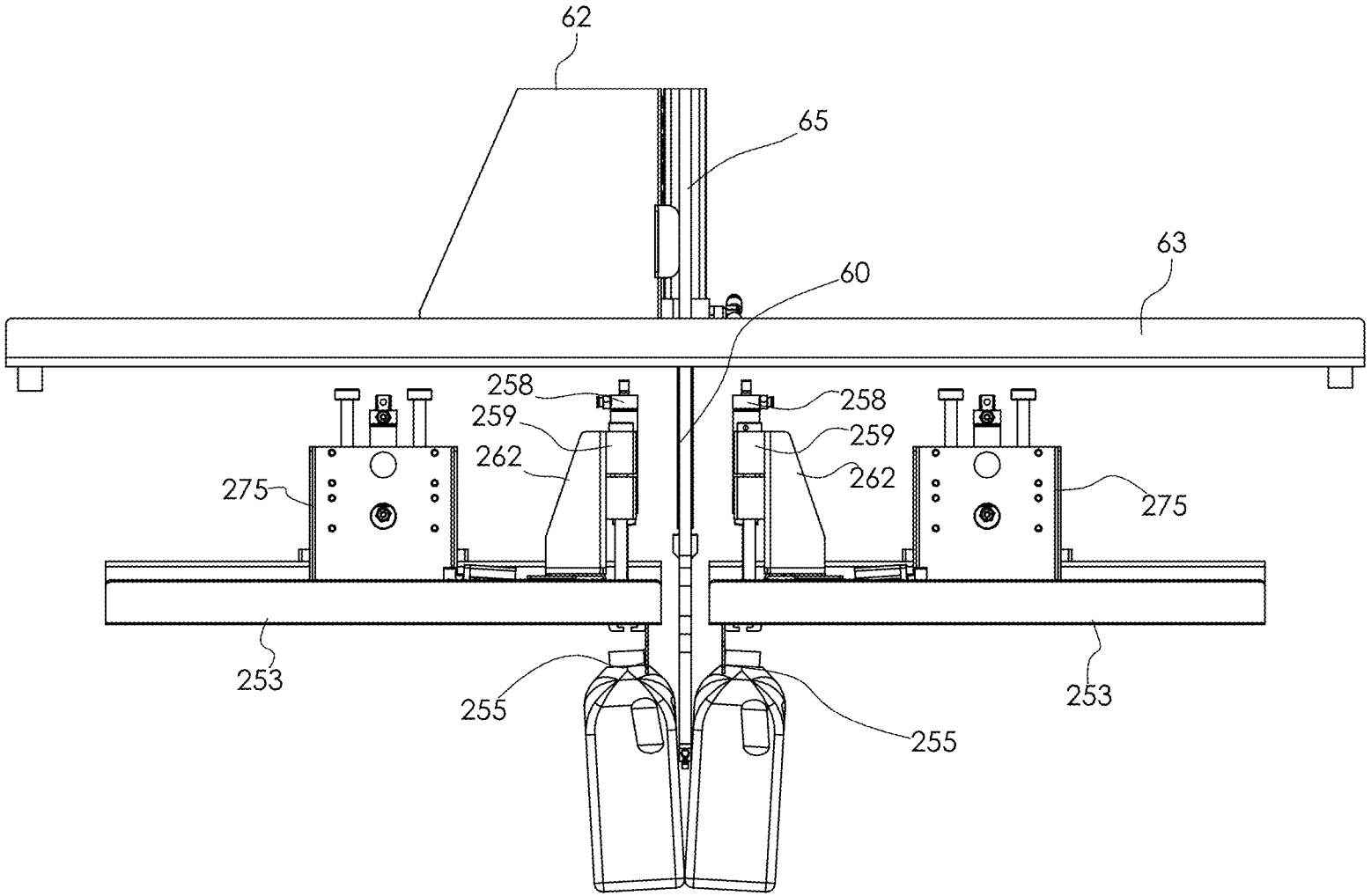

Referring to FIG. 9, each neck rail 255 is driven by an actuating assembly 257 attached to a support 262 which is mounted on the respective neck rail platforms 253. The actuating assembly 257 may include a pneumatic actuator 258 connected to a pressurized air source (not shown), a pair of linear shafts 259, and a housing 260 for housing bearings/bushings. In response to actuator 258 being urged by the pressurized air source to an extended position, the neck rails 255 moves vertically and toward two adjacent rows of bottles in the article array 50 to create a space or gap therebetween (FIG. 10A). As the neck rails 255 vertically descends and initially contacts the bottles in the article array 50, the neck rails 255 then lateral moves (as shown by arrows in FIG. 10B) to create a gap to allow the cutting device 60 to extend therethrough (FIG. 10C).

It is to be understood that the operation and movements of associated components of the neck rails 255 are controlled by a microprocessor or control unit or controller 100 (FIG. 1), operating in a known manner, and is driven by any appropriate drive mechanism known in the art, and not limited to those disclosed in the exemplary embodiments herein.

Figure 13:
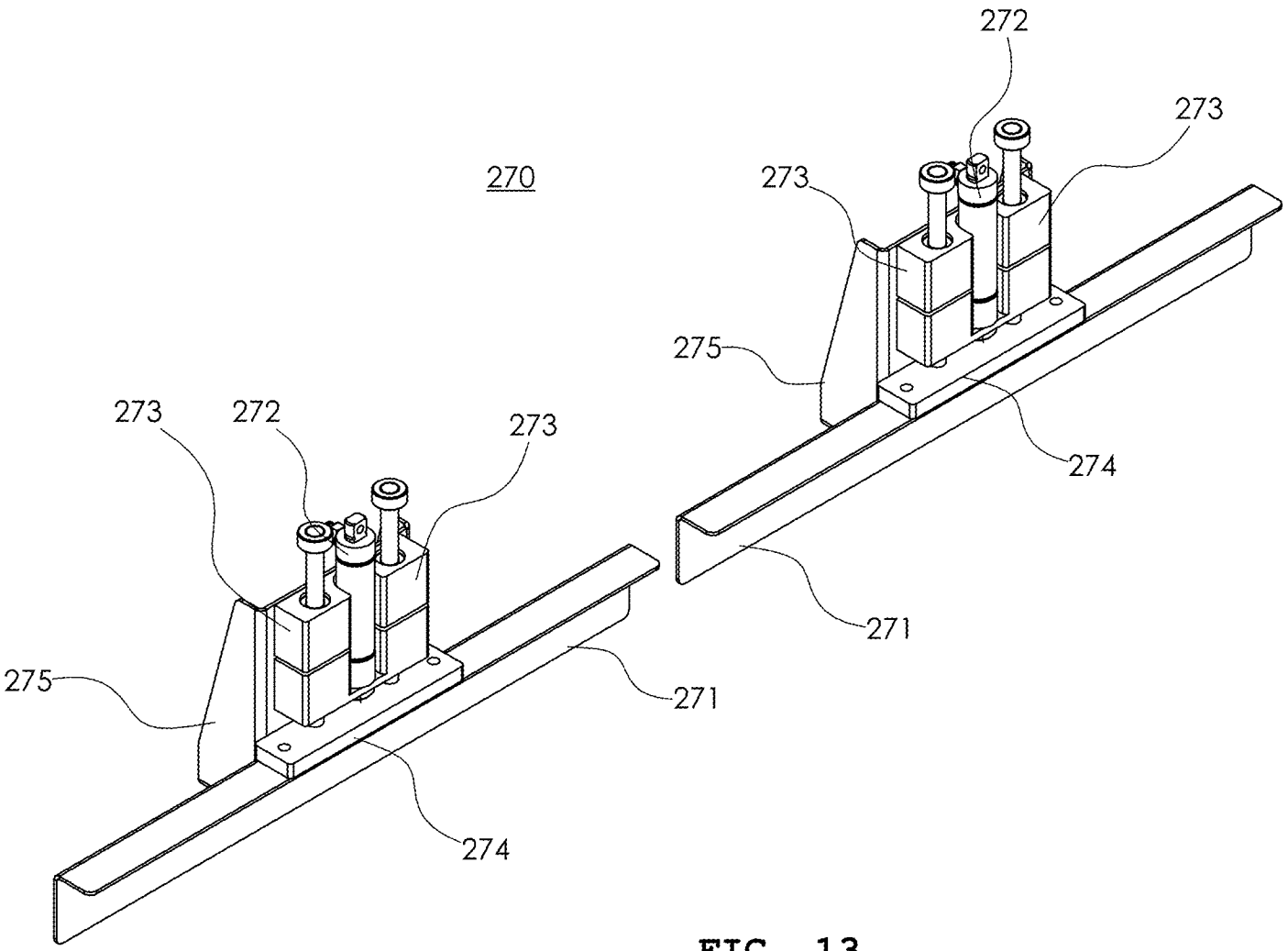
FIG. 13 is a perspective view of an array gate stop assembly, according to an example embodiment.

Referring to FIGS. 9 and 13, the neck rail assembly 250 further includes a pair of array stop gate assemblies 270 for stopping or blocking the article array 50 from advancing in the debagging area 14. That is, once the article array 50 enters the debagging area 14, the array stop gate assemblies 270 descend downwardly into the debagging area 14 to prevent the article array 50 from advancing forward such that a (second) cutting operation and removal of packing material 52 are performed. As shown, each array stop gate assembly 270, mounted on a support 275, is located at the end of the neck rail assembly 250 near the article collection area 18. Each array stop gate assembly 270 includes a stop gate 271 that is controlled by a pneumatic actuator 272 connected to a pressurized air source (not shown), a pair of linear shafts 273, and a housing 274 for housing bearings/bushings. In response to actuator 272 being urged by the pressurized air source to an extended position, the stop gate 271 moves vertically downward to act as a stopping mechanism and prevent the article arrays 50 from advancing forward. The descended stop gate 271 engages an upper portion of the article array 50 to prevent forward movement. Once the packing material 52 is cut and removed, the stop gate 271 is retracted to its initial position, i.e., lifted, to wait for the next article array 50 to be received.

It is to be understood that the operation and movements of associated components of the array stop gate assemblies 270 are controlled by a microprocessor or control unit or controller 100 (FIG. 1), operating in a known manner, and is driven by any appropriate drive mechanism known in the art, and not limited to those disclosed in the exemplary embodiments herein.

The operation of an apparatus of the disclosed system 10 will now be described, with reference to FIGS. 8A-8H.

Figure 8A:
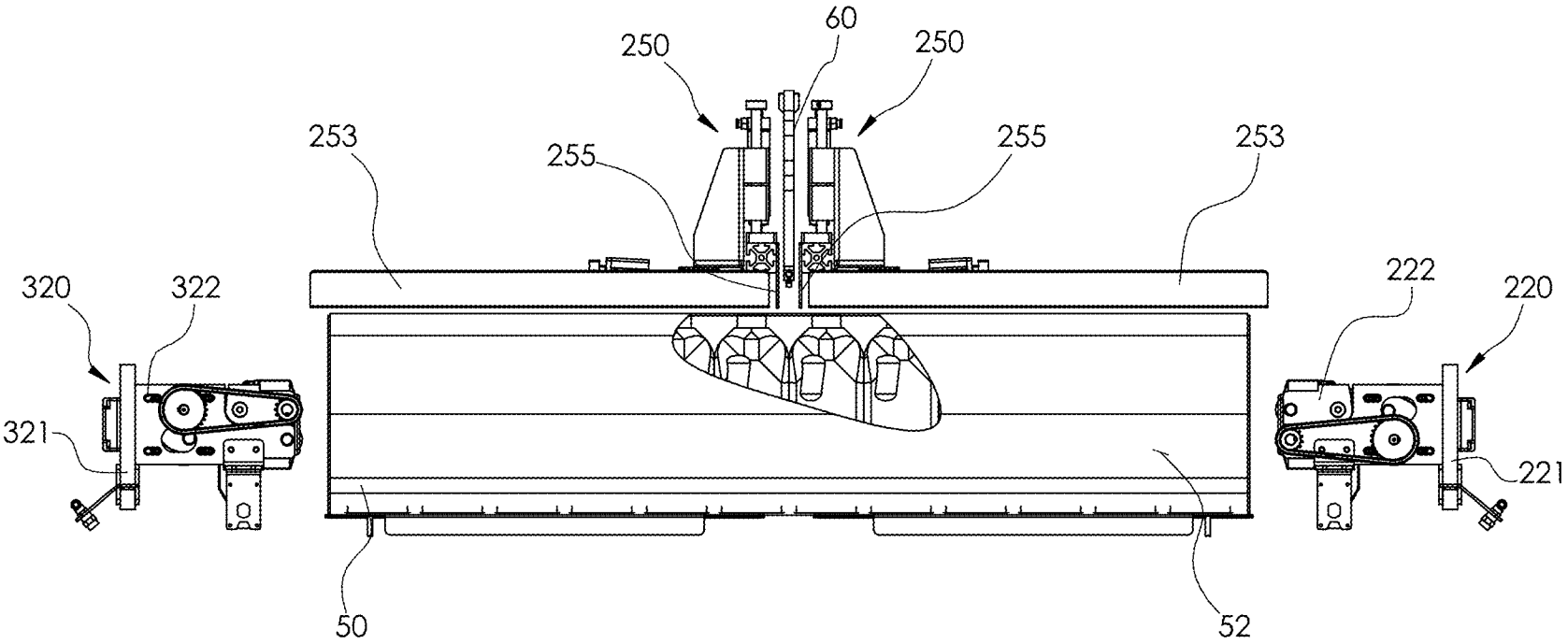
FIGS. 8A-8H are sequential operational movements of first and second bag gripping subassemblies, according to example embodiments.

Referring now to FIG. 8A, it will be seen that when the article array 50 enters the debagging area 14 of system 10, the first and second bag gripping subassemblies 220, 320 are in their initial positions. As a result, there is provided a space between the article array 50 and the respective first and second bag gripping subassemblies 220, 320, defining a first, spaced-apart, position. Also, the neck rails 255 and the second cutting device 60 are at their retracted positions, defining a first initial position.

Figure 8B:
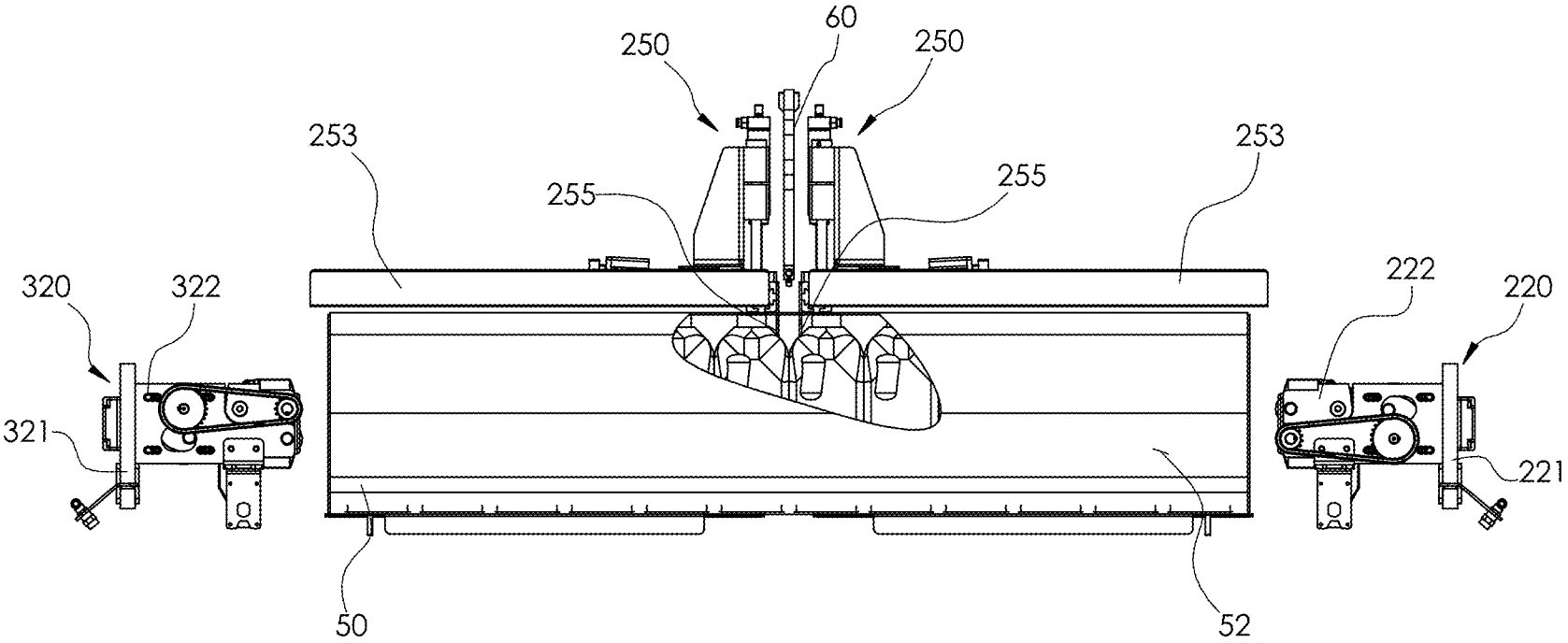

Referring now to FIG. 8B, the neck rails 255 have been actuated to descend the neck rails 255 towards the bottles of the article array 50. Due to the packing material 52 of the article array 50 having been partially cut on the upper portion thereof by the first cutting device 29, the neck rails 255 can protrude into the article array 50 and easily engage the adjacent rows of bottles for separation.

Figure 8C:
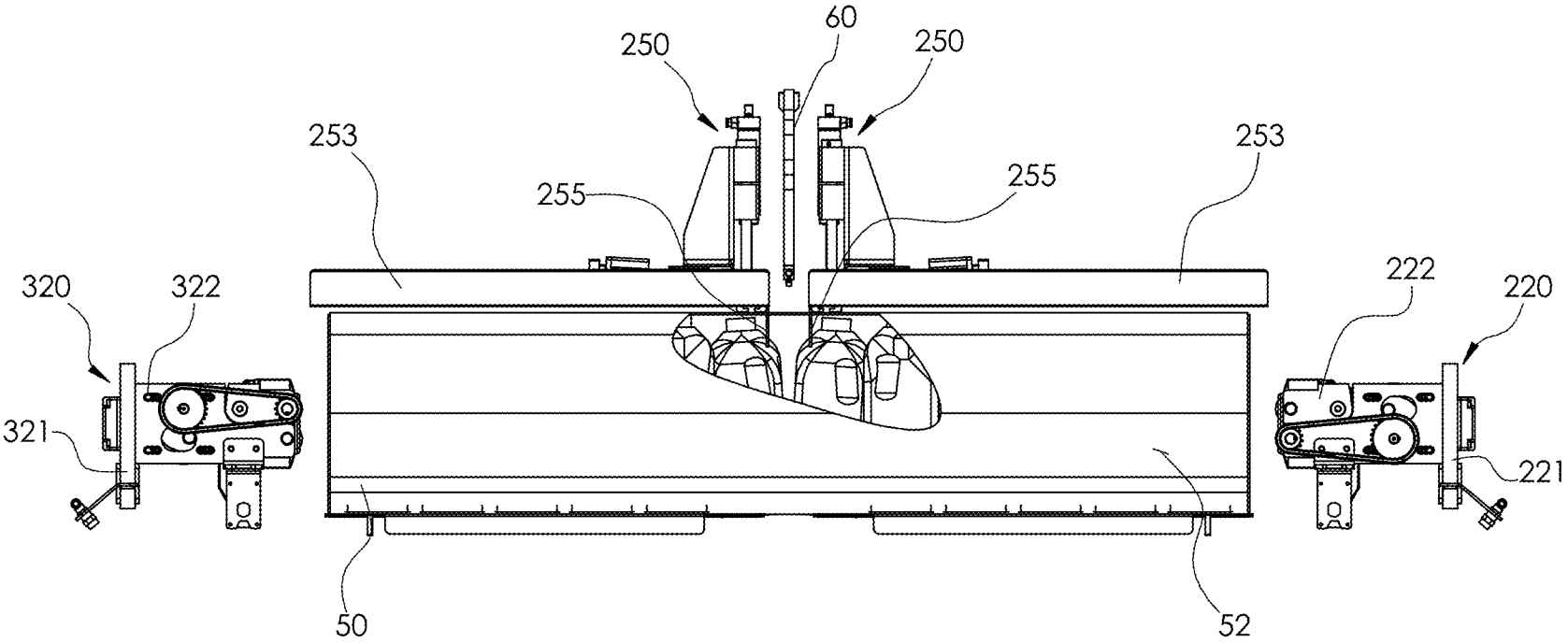

Referring now to FIG. 8C, once the neck rails 255 engages the bottles, the neck rails 255 then translate in an outwardly direction, i.e., away from the center of table 24, creating a spacing therebetween. The spacing should be sufficient to allow the second cutting device 60 to descend towards the article array 50 for cutting the packing material 52.

Figure 8D:
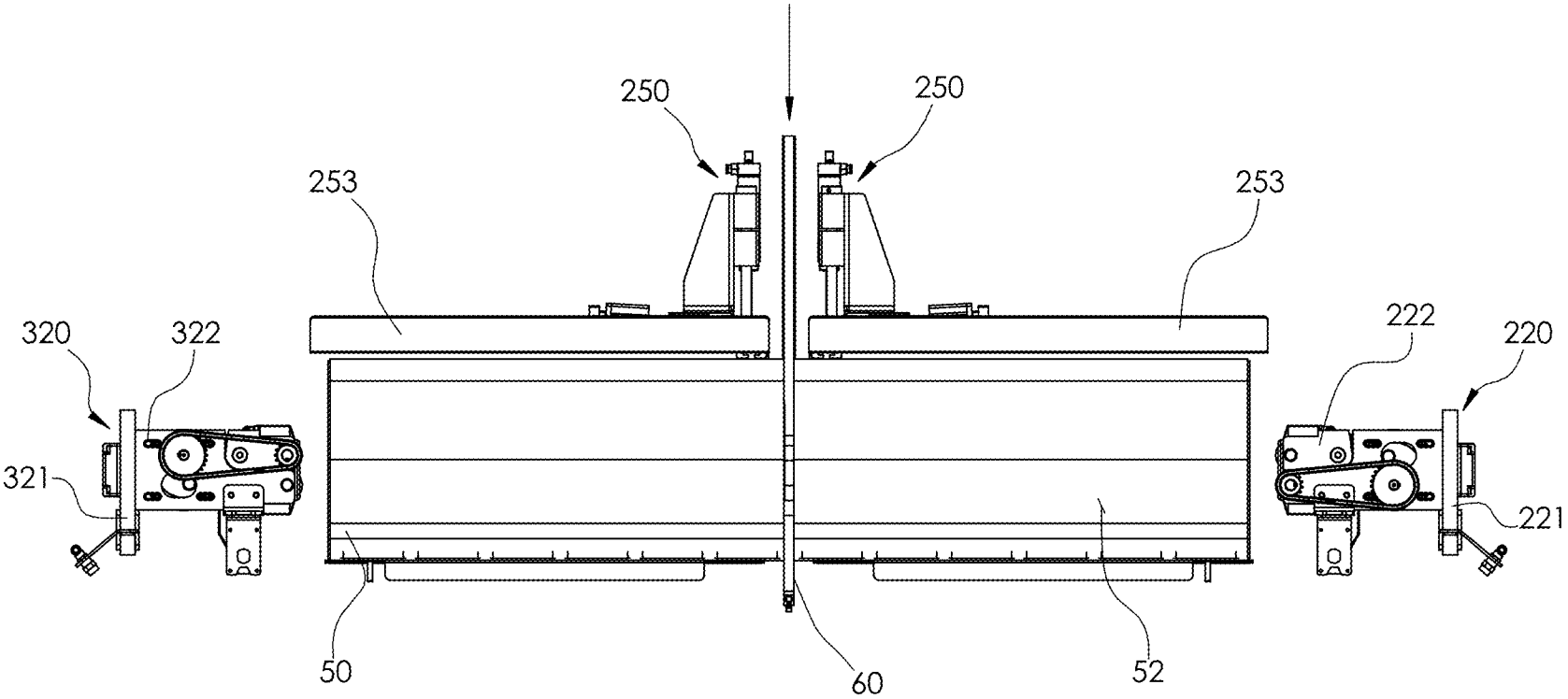

Referring now to FIG. 8D, the second cutting device 60 (via e.g., heatable wire) has been actuated to descend the second cutting device 60 entirely through the packing material 52 of the article array 50, as indicated by the arrow in FIG. 8D. As a result, the packing material 52 is partitioned into at least two sections (FIG. 15) allowing the packing material 52 to be easily grabbed and removed by the grippers 225, 325 of the first and second bag gripping subassemblies 220, 320, respectively. The two partitioned packing material 52 also reduces and/or prevents the grippers 225, 325 from jamming, getting stuck, or trapped when the packing material 52 moves through the grippers 225, 335.

Figure 8E:
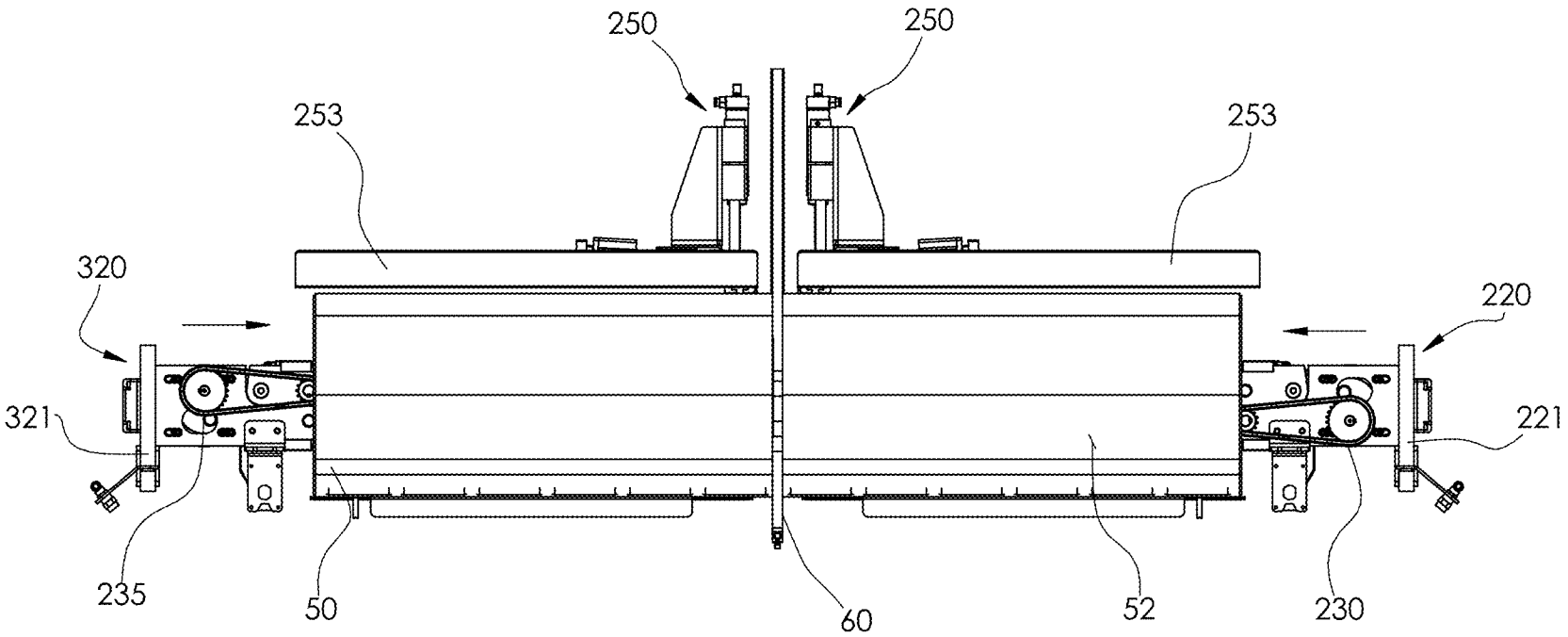
Figure 8F:
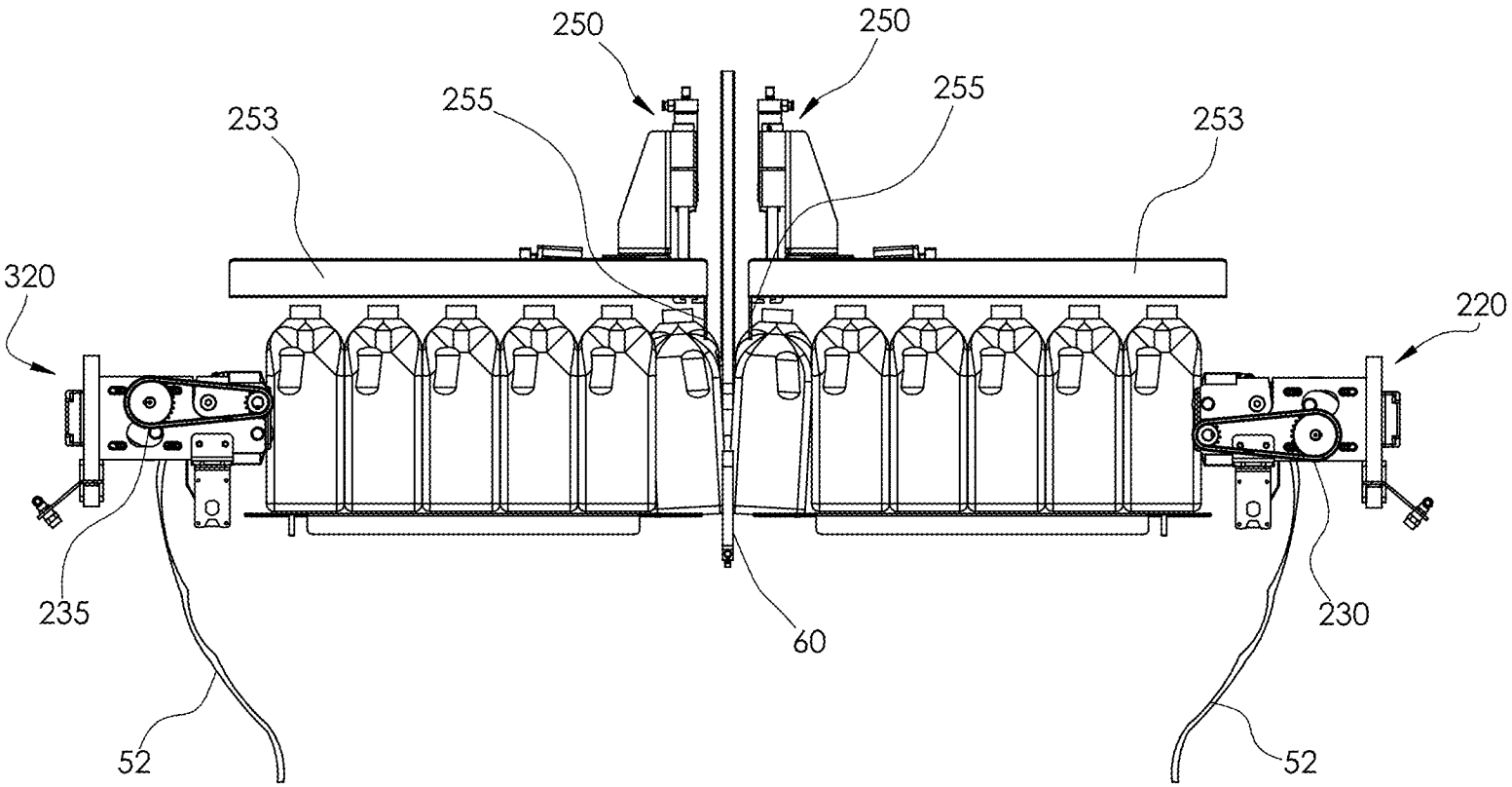

Referring now to FIG. 8E, the first and second bag gripping subassemblies 220, 320 have been actuated to laterally move the first and second bag gripping subassemblies 220, 320 towards the article array 50 to engage the packing material 52 for removal. More specifically, the first and second grippers 225, 335 containing the plurality of top and bottom rollers 227, 228 (as shown in FIG. 11) engage the packing material 52 and press against the outer rows of bottles. This is done by moving the first and second bag gripping subassemblies 220, 320 inwards towards the center of table 24 (or towards each other), as indicated by the arrows in FIG. 8E. This is specifically accomplished in this embodiment by causing the first and second stripping assemblies 210, 310 to move towards the center of table 24. While the first and second bag gripping subassemblies 220, 320 move inward towards the article array 50, the bottom rollers 228 rotate in a first direction driven by the roller drive apparatus 230 and the top rollers 227 rotate in a second direction (opposite the first direction) driven by the roller drive apparatus 235. In an exemplary embodiment, the direction of rotation of rollers 227, 228 is indicated by the arrows in FIG. 11. In moving to engage, the rotating rollers 227, 228 contact the packing material 52 along a horizontal formation and grab the packing material 52 between the rotating rollers 227, 228 for removing the packing material 52. Further, as each roller 227, 228 is of a high friction material, the rollers 227, 228 will pull the packing material 52 downward to the packing material collection area 16 to be collected and discarded. The rollers 227, 228 continue to rotate until the packing material 52 is removed from the article array 50 (as shown in FIG. 8F).

Figure 8G:
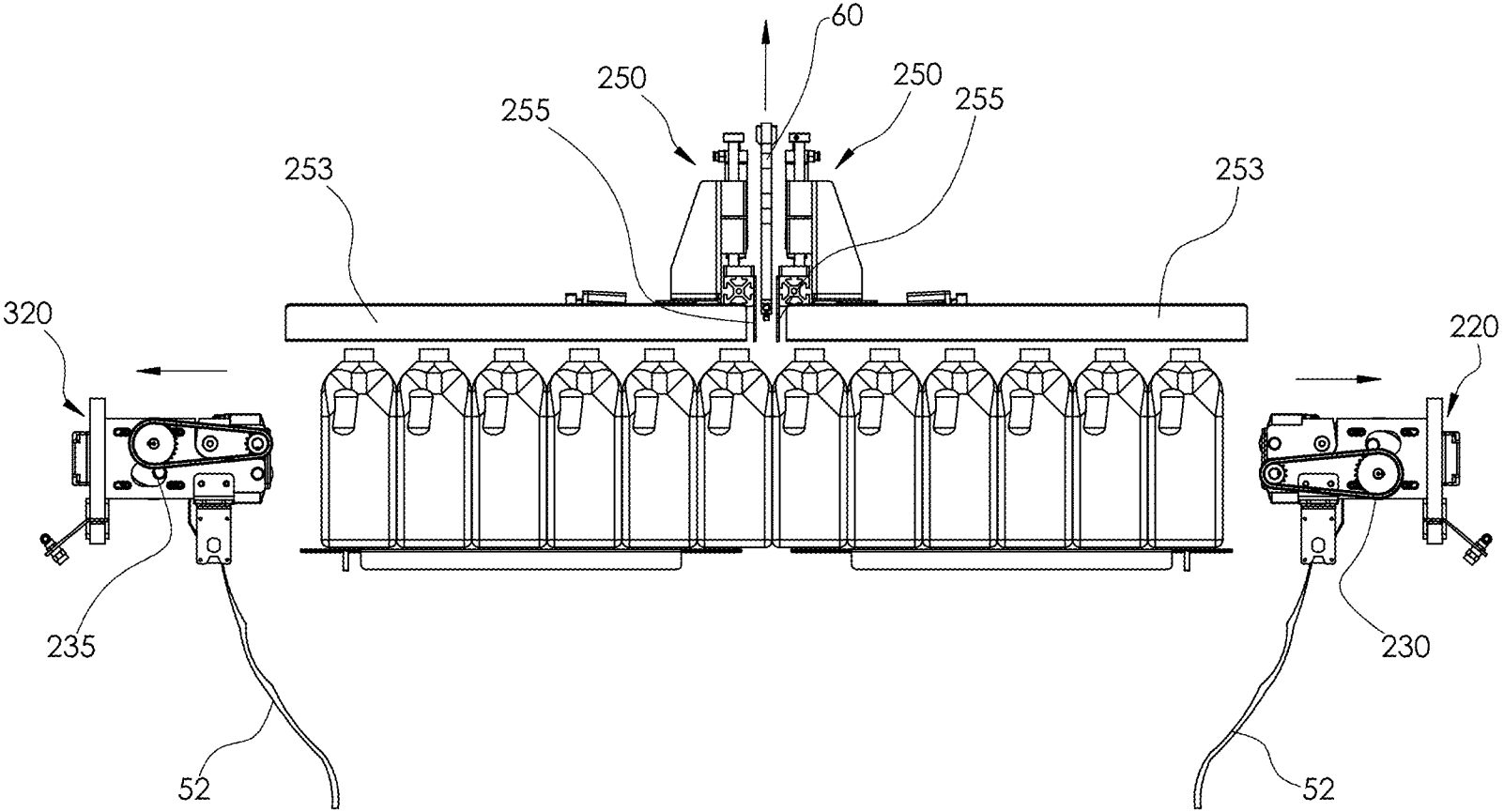
Figure 8H:
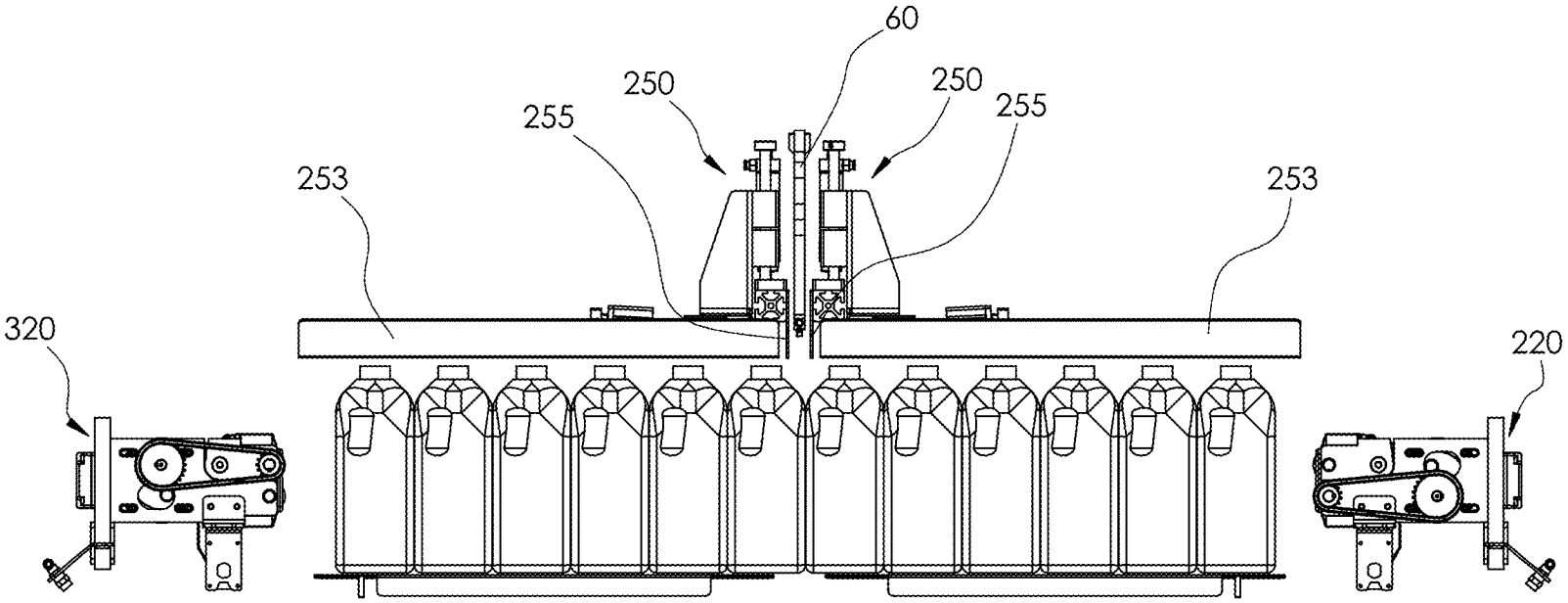

Referring now to FIG. 8G, while the packing material 52 is being removed via rollers 227, 228, the first and second bag gripping subassemblies 220, 320 retract and return to their initial positions or first, spaced-apart, position. This is done by laterally moving the first and second bag gripping subassemblies 220, 320 away from the center of table 24 (or away from each other) as indicated by the arrows in FIG. 8G. In addition, the neck rails 255 and the second cutting device 60 are also returned to their respective initial positions as defined by the first retracted position. More specifically, a leading edge of the second cutting device 60 is raised above the neck rail platform 253 and a leading edge of the neck rails 255 is raised to be contained within the neck rail platform 253. This ensures that the components do not interfere with the next article array 50 entering the debagging area 14. Thereafter, the unwrapped (or removed) article arrays of bottles (as shown in FIG. 8H) are pushed into the article collection area 18 when the next article array 50 enters the debagging area 14 to be handled.

While the operations as described above in FIGS. 8A-8H are illustrated as individual actions, it should be appreciated that the operations can be simultaneously or concurrently performed at the same time. For example, while the first and second bag gripping subassemblies 220, 320 retract to their initial positions, the neck rails 255 and/or the second cutting device 60 can be concurrently retracting to their respective initial positions.

Figure 16A:
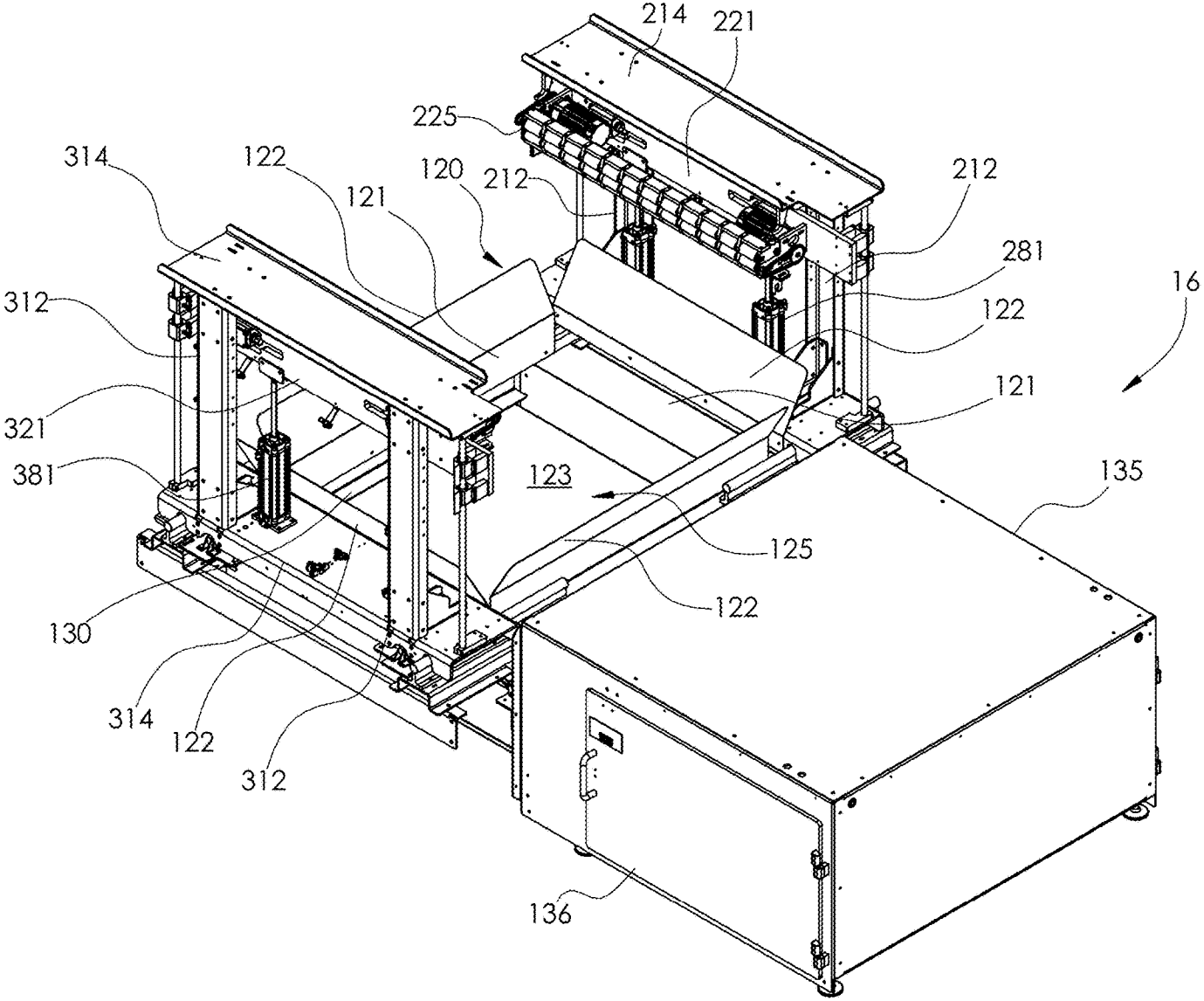
FIGS. 16A and 16B are perspective views of a packing material collection area of the exemplary debagging system of FIG. 1, according to an example embodiment.
Figure 16B:
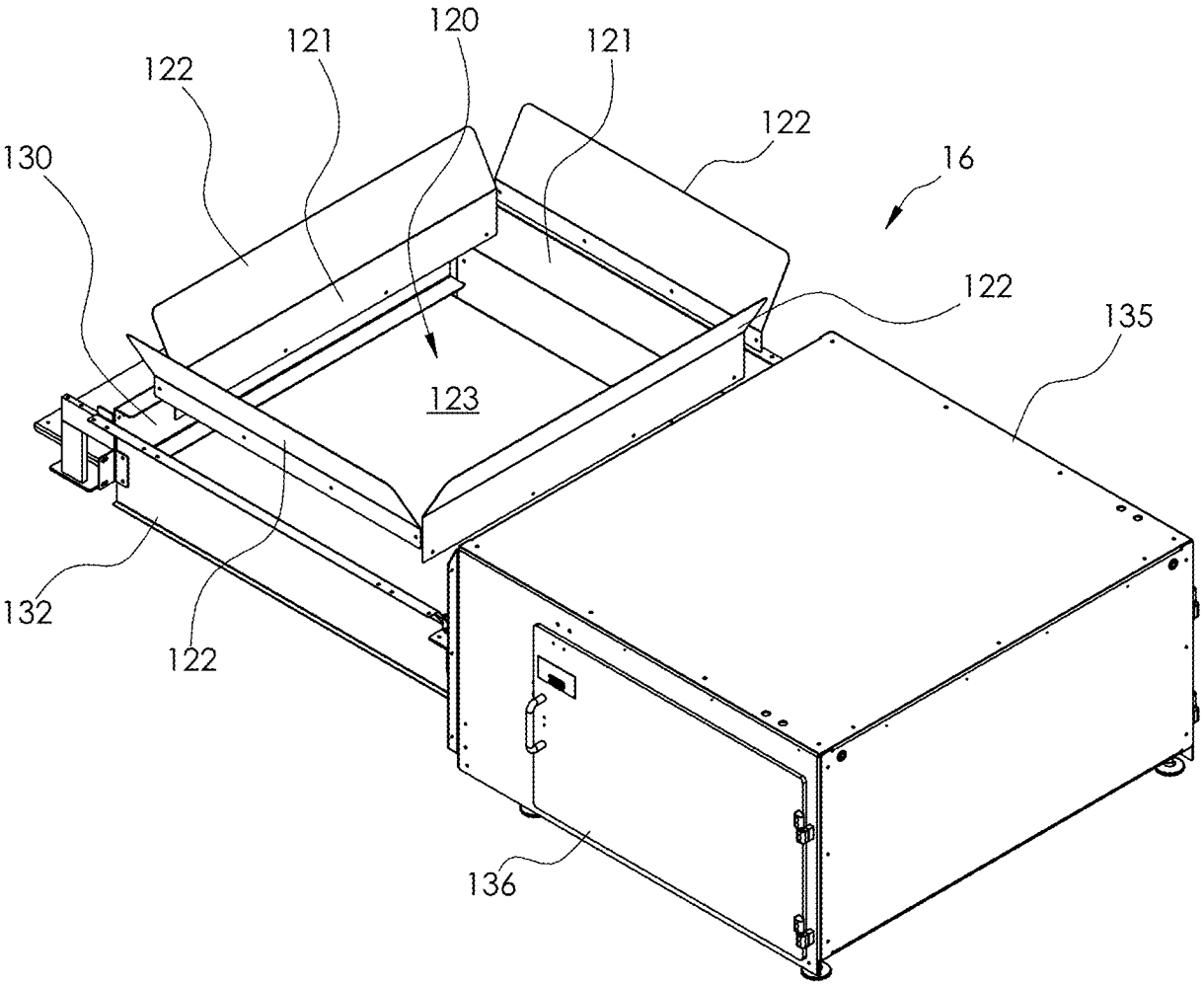

Referring to FIGS. 16A and 16B, there is shown the packing material collection area 16 located below the debagging area 14 to collect the discarded packing material 52. Once the packing material 52 is removed from the debagging area 14, the rollers 227, 228 transport the packing material 52 into a bag chamber 120 of the packing material collection area 16. The bag chamber 120 is a chamber defined by sidewalls 121 and a chamber floor 123. The bag chamber 120 has a top inlet opening 125 for receiving the discarded packing material 52 from the debagging area 14 and a side outlet opening 126 (FIG. 5B) for transporting the packing material 52 to a collection housing 135 for accessing and removing or discarding the packing material 52 at a later time. Near the inlet opening 125 includes an upward extension member 122 at each sidewall 121 for slidable receiving the discarded packing material 52 from the debagging area 14. The extension members 122 ensure that the discarded packing material 52 falls within and directed towards the top inlet openings 125. The packing material collection area 16 further includes a pusher 130, positioned above the chamber floor 123, to push or transport the discarded packing material 52 to the collection housing 135. The chamber floor 123 is supported on a plurality of rail frames 131 extending in a direction along a travel direction of the pusher 130. The pusher 130 is pushed by elongated shafts 132 mounted at one to a bottom frame 133 and the pusher 130 at the other end (FIG. 7). The elongated shafts 132 are controlled by a pneumatic cylinder 134 attached to the bottom frame 133. Once the discarded packing material 52 is transported to the collection housing 135, the user may open a door 136 in the collection housing 135 to remove or discard the packing material 52. In some implementations, door 136 can be disposed at each side of the packing material collection area 16, as shown in FIG. 7. This ensures an case in handling and removal of the discharged packing materials 52 by the user.

In operation, the discarded packing material 52 released from rollers 227, 228 falls into bag chamber 120 and comes to rest on the floor 123. A selected period of time after the release of the packing material 52 by the rollers 227, 228, the pusher 130 is activated to cause the pusher 130 to travel across the floor 123, thereby pushing the packing material 52 to the side outlet opening 126 and into the collection housing 135. As desired, there may be provided, for example, a pneumatic chute, or a receptacle to receive the packing material 52 pushed into the collection housing 135, whereby the discarded packing material 52 can be accessed via the door 136.

Figure 17:
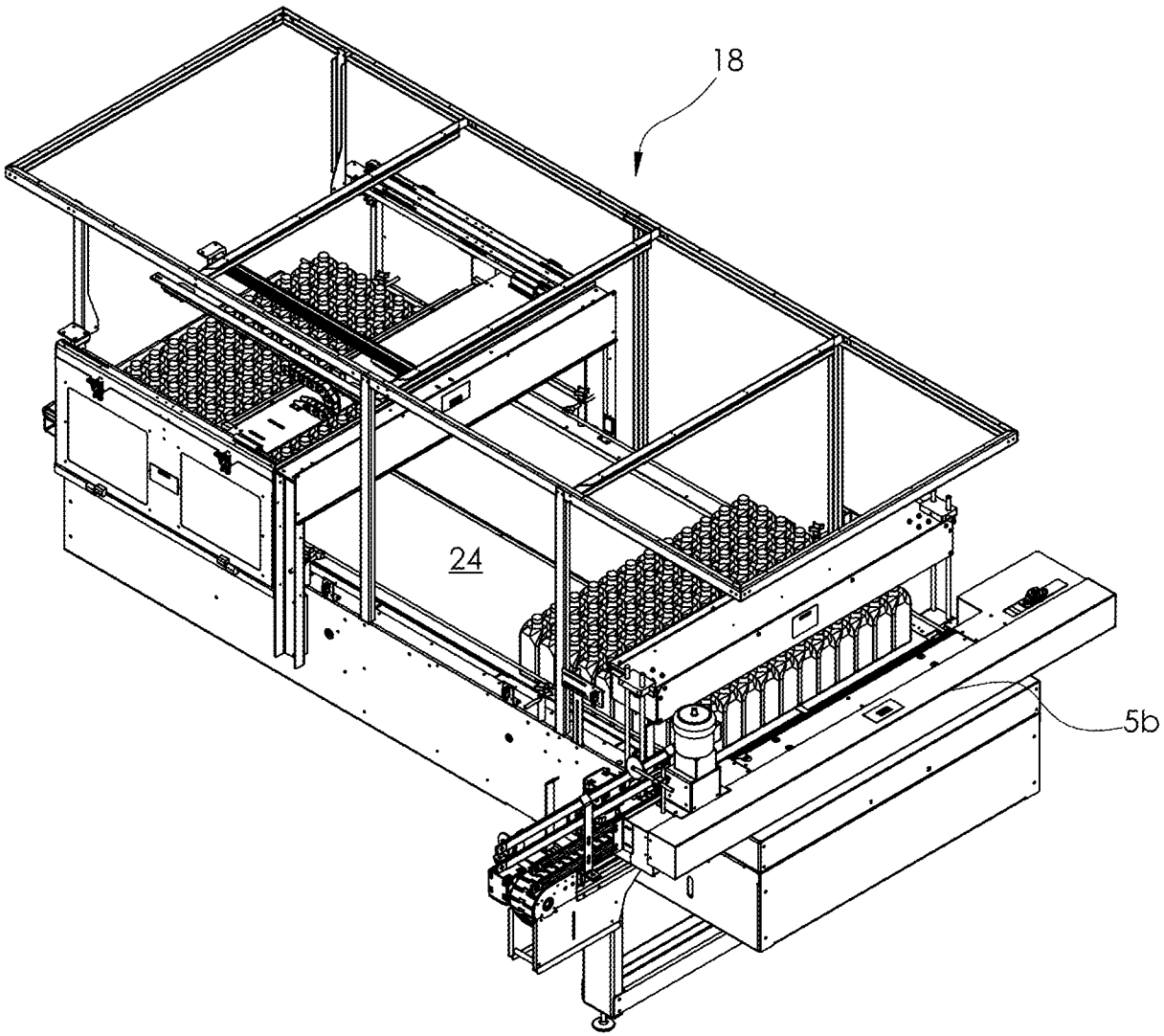
FIG. 17 is a perspective view of an article collection area of the exemplary debagging system of FIG. 1, according to an example embodiment.

Referring to FIG. 17, the unwrapped article arrays of bottles are conveyed to the article collection area 18 which will eventually be transported to a filling system or process. The transportation of bottles can be made by a conveyor attached to the article collection area 18 (not shown). The bottles are collected and temporarily stored in the article collection area 18 until the next batch of unwrapped article arrays of bottles enters the article collection area 18 and pushes the bottles toward the conveyor for filling.

The aspects and embodiments of the invention can be used alone or in combinations with other systems and methods.

The articles "a" and "an," as used herein, mean one or more when applied to any feature in embodiments of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

"At least one," as used herein, means one or more and thus includes individual components as well as mixtures/combinations.

The transitional terms "comprising", "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinarily associated with the specified material(s). The term "consisting essentially of" limits the scope of a claim to the specified elements, steps or material(s) and those that do not materially affect the basic and novel characteristic(s) of the claimed disclosure. All materials and methods described herein that embody the present disclosure can, in alternate embodiments, be more specifically defined by any of the transitional terms "comprising," "consisting essentially of," and "consisting of."

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A system for removing a packing material of an article array, comprising:

a staging area for receiving the article array packaged with the packing material;

a transport device configured to transport the article array in a length direction extending from a first end to a second end of the system;

a first cutter configured to cut the packing material in a direction perpendicular with respect to the length direction of the system in the staging area;

a debagging area configured to sequentially receive from the transport device the article array, the debagging area includes a first gripper assembly and a second gripper assembly configured to translate towards each other in a horizontal direction to engage and remove the packing material at a side portion of the article array;

a second cutter configured to cut the packing material in direction parallel to the length direction in the debagging area; and a packing material collection area configured to receive the packing material from the first and second grippers and collect the packing material to be discarded, wherein the first gripper assembly includes a plurality of first rollers and a plurality of second rollers disposed horizontally and in parallel with respect to each other, and wherein the second gripper assembly includes a plurality of first rollers and a plurality of second rollers disposed horizontally and in parallel with respect to each other.

2. The system of claim 1, wherein the transport device is configured to transport the article array to a position to allow the first cutter to partially cut the packing material at one or more portions of an upper portion of the article array.

3. The system of claim 1, wherein the second cutter is configured to cut the packing material at a center portion of the article array in a perpendicular direction of the cut made by the first cutter, thereby resulting in the packing material to be cut into at least two sections.

4. The system of claim 1, wherein the first gripper assembly and the second gripper assembly are disposed at opposite sides of the debagging area with respect to each other to engage the packing material at respective sides of the article array.

5. The system of claim 1, wherein the first gripper assembly and the second gripper assembly are configured to vertically move with respect to the article array.

6. The system of claim 1, further comprising a pair of neck rails that are configured to engage two adjacent rows of bottles in the article array.

7. The system of claim 6, wherein the pair of neck rails are operated by moving in a downward vertical direction and then in a lateral horizontal direction for creating a spacing between the two adjacent rows of bottles in the article array.

8. The system of claim 7, wherein the second cutter descends between the pair of neck rails to cut the packing material therethrough.

9. The system of claim 1, wherein the packing material collection area is disposed below the debagging area and configured to receive the packing material transported by the first gripper assembly and the second gripper assembly.

10. The system of claim 9, wherein the packing material collection area further includes a housing for collecting the packing material, wherein the housing includes a door for retrieving and removing the discarded packing material.

11. The system of claim 1, further comprising an article collection area, sequentially received from the debagging area, for collecting the articles for transport to a filling system.

12. The system of claim 1, wherein the packing material is of a flexible plastic material.

13. A method of removing a packing material of an article array, comprising:

receiving, in a staging area of a debagging system, the article array packaged with the packing material;

transporting the article array in a first direction;

cutting at a first occurrence, in the staging area, the packing material in a direction which is perpendicular to the first direction;

sequentially transporting the article array to a debagging area of the debagging system;

cutting at a second occurrence different than the first occurrence, in the debagging area, the packing material along in the first direction, wherein the cut made in the debagging area is perpendicular to the cut made in the staging area;

removing the packing material from the article array by engaging the packing material via a first gripper assembly and a second gripper assembly, wherein the first gripper assembly includes a plurality of first rollers and a plurality of second rollers disposed horizontally and in parallel with respect to each other, and wherein the second gripper assembly includes a plurality of first rollers and a plurality of second rollers disposed horizontally and in parallel with respect to each other; and collecting, in a packing material collection area, the packing material to be discarded.

14. The method of claim 13, wherein the cut made in the debagging area results in the packing material to be partitioned into at least two sections.

15. The method of claim 13, further comprising a pair of neck rails that are configured to engage two adjacent rows of bottles in the article array.

16. The method of claim 15, wherein the pair of neck rails are operated by moving in a downward vertical direction and then in a lateral horizontal direction for creating a spacing between the two adjacent rows of bottles in the article array.

17. The method of claim 13, further comprising transporting the article arrays, sequentially received from the debagging area, to an article collection area for transport to a filling system.

18. The method of claim 13, wherein the cutting at the second occurrence is made at a center portion of the article array, thereby resulting in the packing material to be cut into at least two sections.

19. The method of claim 13, wherein the first gripper assembly and the second gripper assembly are disposed at opposite sides of the debagging area with respect to each other to laterally translate and engage the packing material at respective sides of the article array.

20. A system for removing a packing material of an article array, comprising:

a staging area for receiving the article array packaged with the packing material;

a transport device configured to transport the article array in a length direction extending from a first end to a second end of the system;

a first cutter configured to cut the packing material in a direction perpendicular with respect to the length direction of the system in the staging area;

a debagging area configured to sequentially receive from the transport device the article array, the debagging area includes a first gripper assembly and a second gripper assembly configured to translate towards each other in a horizontal direction to engage and remove the packing material at a side portion of the article array;

a second cutter configured to cut the packing material in direction parallel to the length direction in the debagging area; and a packing material collection area configured to receive the packing material from the first and second grippers and collect the packing material to be discarded, wherein a plurality of first rollers of the first and second assemblies rotate in a first direction and a plurality of second rollers of the first and second assemblies rotate in a second direction opposite the first direction.

* * * * *